US008585303B2

(12) United States Patent
Imamura et al.

(10) Patent No.: US 8,585,303 B2
(45) Date of Patent: Nov. 19, 2013

(54) LABEL PRODUCING APPARATUS WITH OPTICAL SENSOR AND EXTERNAL LIGHT CORRECTION

(75) Inventors: Yusuke Imamura, Nagoya (JP); Yasuhiro Iriyama, Mie-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 347 days.

(21) Appl. No.: 13/033,012

(22) Filed: Feb. 23, 2011

(65) Prior Publication Data

US 2011/0217108 A1 Sep. 8, 2011

(30) Foreign Application Priority Data

Mar. 4, 2010 (JP) ..... 2010-047523

(51) Int. Cl.
*B41J 29/38* (2006.01)
*B41J 11/46* (2006.01)

(52) U.S. Cl.
USPC ..... 400/76; 400/578; 400/583

(58) Field of Classification Search
USPC ..... 400/76, 583, 583.3, 578
See application file for complete search history.

(56) References Cited

U.S. PATENT DOCUMENTS 5,059,877 A * 10/1991 Teder ..... 318/444
5,900,888 A 5/1999 Kurosawa
2007/0246524 A1 * 10/2007 Booth et al. ..... 235/379

FOREIGN PATENT DOCUMENTS

JP 59166888 A * 9/1984 ..... G01V 9/04
JP 01232087 A * 9/1989 ..... B41J 29/48
JP 09-001816 1/1997
JP 2002-002966 1/2002
JP 2007-076267 3/2007

* cited by examiner

*Primary Examiner* — Daniel J Colilla
(74) *Attorney, Agent, or Firm* — McCarter & English, LLP

(57) ABSTRACT

This disclosure discloses a label producing apparatus comprising: a housing; a feeding device that feeds a label tape; a printing device that prints desired print; an optical sensor comprising a light projecting device and a light receiving device capable of outputting a detected voltage value; a light-on control portion that controls said optical sensor so that said light projecting device is turned on; an initial value storage device that stores a predetermined initial threshold value; a threshold value correction portion that calculates a corrected threshold value using said initial threshold value; a mark detecting portion that detects a positioning mark by an arrival of said detected voltage value at said corrected threshold value after calculation of said corrected threshold value; a feeding control portion that controls said feeding device; and a print control portion that controls a print operation of said printing device.

3 Claims, 17 Drawing Sheets

LABEL PRODUCING APPARATUS WITH OPTICAL SENSOR AND EXTERNAL LIGHT CORRECTION

CROSS-REFERENCE TO RELATED APPLICATION

The present application claims priority from Japanese Patent Application No. 2010-47523, which was filed on Mar. 4, 2010, the disclosure of which is incorporated herein by reference in its entirety.

BACKGROUND

1. Field

The present disclosure relates to a printed label producing apparatus and a label producing method for printing print on a label tape and creating a printed label.

2. Description of the Related Art

In prior art, there has been proposed a label producing apparatus that produces a printed label by storing a tape that serves as a print-receiving material in a roll shape inside a tape cartridge, printing desired print on the tape as the tape is fed out from the roll, and cutting the tape with print with a cutter.

For such a label producing apparatus, a technique has been proposed in which a light-absorbing black mark is printed in a predetermined position in the feeding direction of the tape in advance, and a mark sensor capable of optically detecting this black mark is provided to detect the position of the tape in the feeding direction. The above-described mark sensor used in such a case is generally a reflective sensor comprising a light projecting device and a light receiving device, and detects the reflected light of the light projected from the light projecting device using the light receiving device. The behavior of the black mark that exhibits a lower amount of reflected light compared to other sections is then used to detect the passing of the black mark at the mark sensor.

Nevertheless, often there are cases where the mark sensor is disposed near the tape discharging exit of the label producing apparatus in order to carry out this role. As a result, external light may enter the housing from the discharging exit of the housing depending on the format of use of the user, such as indoor or outdoor use in a bright location, for example, affecting detection of the black mark by the above-described optical technique. With such an arrangement, a decrease in detection accuracy of the tape position with respect to the tape feeding direction occurs, resulting in variance of the feeding distance and a shift in the printing position, possibly decreasing the quality of the printed label.

SUMMARY

It is therefore an object of the present disclosure to provide a label producing apparatus and a label producing method capable of producing a high quality printed label without variance in the feeding direction or shift in the printing position.

In order to achieve the above-mentioned object, an aspect of the present application comprises: a housing including a discharging exit; a feeding device provided inside the housing that feeds a label tape comprising a light-absorbing positioning mark toward the discharging exit; a printing device that prints desired print on the label tape to be fed by the feeding device or a print-receiving tape to be bonded to the label tape; an optical sensor provided inside the housing, and comprising a light projecting device capable of projecting light toward a feeding path of the label tape to be fed by the feeding device and a light receiving device capable of outputting a detected voltage value corresponding to a received amount of light; a light-on control portion that controls the optical sensor so that the light projecting device is turned on in accordance with an input of a label production instruction signal; an initial value storage device that stores a predetermined initial threshold value in relation to the detected voltage detected by the light receiving device; a threshold value correction portion that calculates a corrected threshold value using the initial threshold value stored in the initial value storage portion in accordance with a correction instruction signal issued at a predetermined time at which the light projecting device is off and an external light can enter the inside of the housing from the discharging exit; a mark detecting portion that detects the positioning mark by an arrival of the detected voltage value of the light receiving device at the corrected threshold value after calculation of the corrected threshold value by the threshold value correction portion and with the light projecting device in an on state; a feeding control portion that controls the feeding device so that feeding is started in accordance with an input of the label production instruction signal, and to control a feeding operation of the feeding device based on a detection result of the mark detecting portion; and a print control portion that controls a print operation of the printing device based on the detection result of the mark detecting portion.

According to the label producing apparatus of the aspect of the present disclosure, a light-absorbing positioning mark is provided on the label tape. When the reflected light of the light projected from the light projecting device of the optical sensor is detected by the light receiving device, this positioning mark has a decreased amount of reflected light compared to other sections. As a result, when light is projected toward the positioning mark, the detected voltage value outputted by the light receiving device changes (decreases or increases) in accordance with the amount of light. The mark detecting portion detects the positioning mark utilizing this behavior of the positioning mark and, based on the detection result, the feeding control portion controls the feeding operation of the feeding device and the printing control portion controls the printing operation of the printing device.

With the detection of the positioning mark based on the aforementioned detected voltage value, the above-described detection is achieved by comparing the sizes of the detected voltage and the predetermined threshold value. In the aspect of the present disclosure, the predetermined initial threshold value corresponding to the range of the detected voltage value is predetermined and stored in the initial value storage device.

In this case, during printed label production, the detected voltage value relatively increases (or relatively decreases) when light is projected on any area on the fed label tape other than the area of the positioning mark, and decreases (or increases) when light is projected on the positioning mark. That is, the detected voltage value exhibits presumed size fluctuation within a predetermined fluctuation range. When the detected voltage value during this fluctuation arrives at the above-described initial threshold value, it is possible to detect the positioning mark based thereon.

Note that external light may enter the housing from the discharging exit of the housing depending on the format of use of the user, such as indoor or outdoor use in a bright location, for example, affecting detection of the positioning mark by the above-described optical sensor. According to prior art, while the positioning mark is detected by a significant decrease in the received amount of light of the light receiving device and a significant change in the detected voltage based on the nature of the light absorbing characteristics of the positioning mark as described above, when the above-described external light enters the apparatus, the changing behavior of the received amount of light of the light receiving device caused by the positioning mark is alleviated by the external light. That is, the decrease in the amount of change of the detected voltage previously described decreases the fluctuation width of the detected voltage, possibly resulting in the received amount of light failing to arrive at the initial threshold value even when light is projected on the positioning mark, making positioning mark detection difficult.

According to the aspect of the present disclosure, the threshold value correction portion corrects the initial threshold value taking into consideration the effect of the above-described external light, based on the correction instruction signal. That is, the corrected threshold value is calculated at a predetermined time when the light projecting device is in an off state and external light can enter from the discharging exit. As a result, it is possible to set a new corrected threshold value in accordance with the fluctuation width at the time external light that presumably has a narrower fluctuation width enters. With this arrangement, it is possible to make the voltage value corresponding to the received amount of light when light is projected on the positioning mark lower (or higher) than the corrected threshold value and thus reliably detect the positioning mark.

Therefore, regardless of the behavior of the detected voltage caused by the above-described entry of external light, the positioning mark can be detected with high accuracy. As a result, feeding control and printing control can be performed with high accuracy regardless of the format of use of the user, making it possible to produce a high-quality printed label without variance in the feeding distance or shift in the printing position.

DETAILED DESCRIPTION OF THE PREFERRED EMBODIMENTS

The following describes an embodiment of the present disclosure with reference to accompanying drawings. The present embodiment is of a case where the present disclosure is applied to an RFID label producing system.

The overall configuration of a tag label producing system comprising a label producing apparatus of the embodiment will now be described with reference to FIG. 1.

Figure 1:
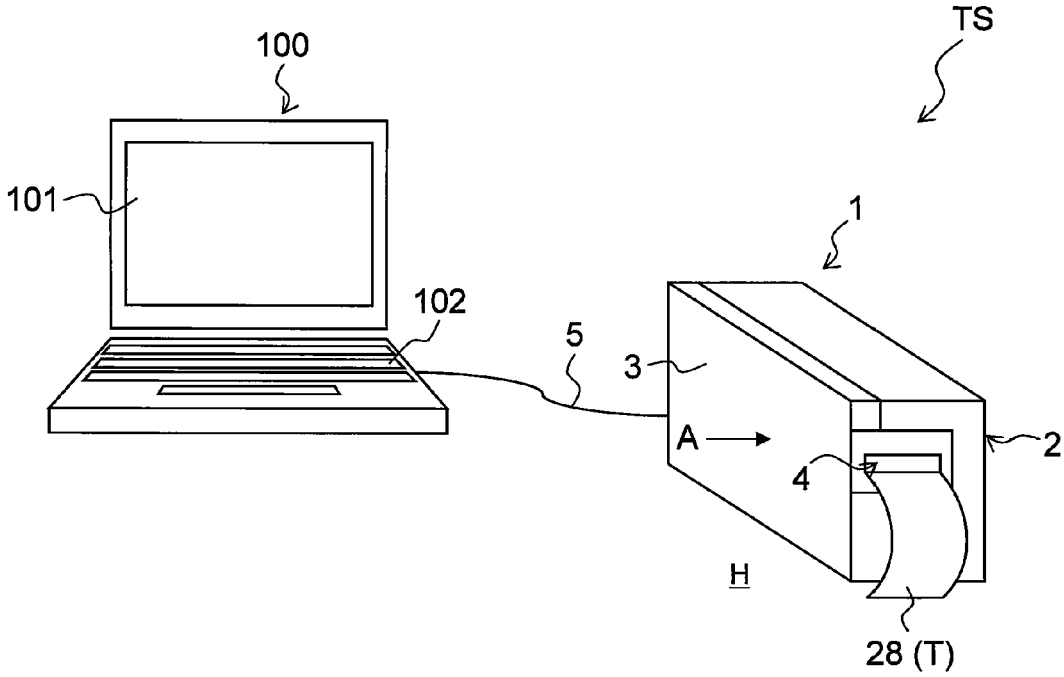
FIG. 1 is a system configuration diagram illustrating the overall configuration of a printed label producing system comprising a tag label producing apparatus of an embodiment of the present disclosure.

In FIG. 1, a tag label producing system TS comprises a tag label producing apparatus 1 (printed label producing apparatus) and an operation terminal 100.

The tag label producing apparatus 1 is disposed on an installation surface H, and comprises an apparatus main body 2. A tape discharging exit 4 is provided on the front surface of the apparatus main body 2. The tape discharging exit 4 discharges an RFID label Tape 28 with print that was produced within the apparatus main body 2 to the outside of the apparatus main body 2. An opening/closing lid 3 is provided on the left surface of the apparatus main body 2. The opening/closing lid 3 is formed in an openable and closable (or detachable) manner, and is designed to cover a cartridge holder 8 (refer to FIG. 2 described later).

The operation terminal 100 comprises a display part 101 that executes various displays, and an operation part 102 for performing various operations.

In addition, the tag label producing apparatus 1 and the operation terminal 100 are connected in an information intercommunicable way via a cable 5 (a USB cable, for example; wireless is acceptable too).

Figure 2:
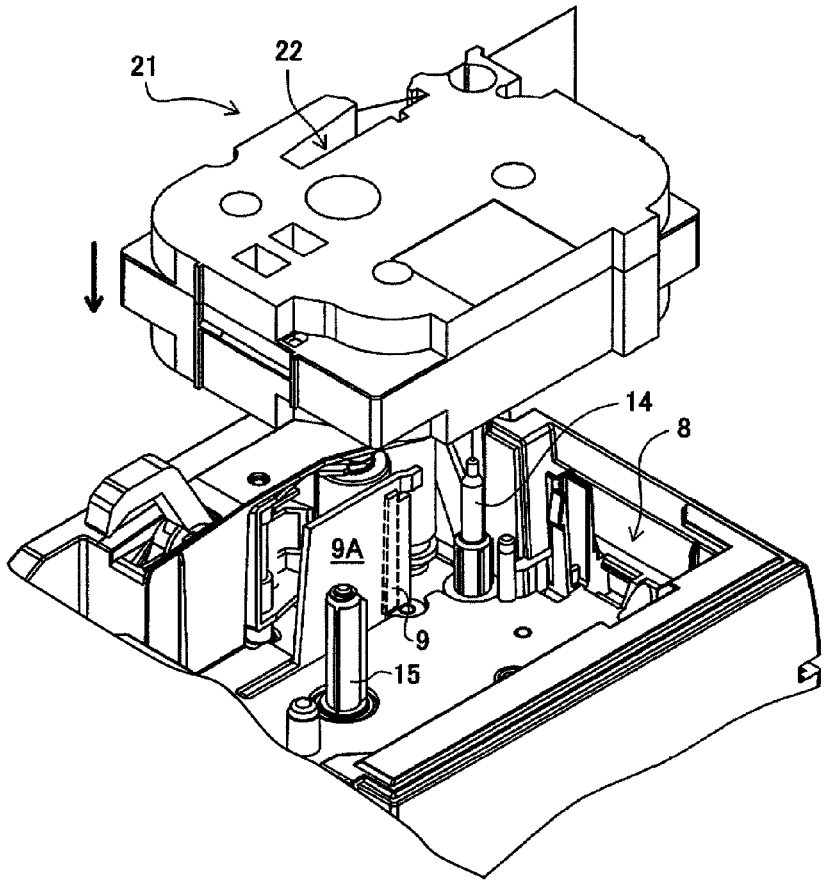
FIG. 2 is a perspective view illustrating the outer appearance configuration of a cartridge holder inside the tag label producing apparatus main body and a cartridge mounted thereto, with the opening/closing lid of the apparatus open.

The outer appearance configuration of the cartridge holder 8 and the cartridge of the tag label producing apparatus 1 will now be described with reference to FIG. 2. In FIG. 2, the illustration of the opening/closing lid 3 opened leftward in FIG. 1 has been omitted to avoid illustration complexities.

In FIG. 2, the cartridge holder 8, a print head 9, a heat sink 9A, a feeding roller driving shaft 14, and a ribbon take-up roller driving shaft 15 are provided in the interior of the apparatus main body 2 of the tag label producing apparatus 1.

The cartridge holder 8 comprises a cartridge 21 in a detachable manner.

The print head 9 prints desired print on a cover film 51 (refer to FIG. 3 described later).

The feeding roller driving shaft 14 and the ribbon take-up roller driving shaft 15 provide the feeding driving power of a tag tape 53 (refer to FIG. 3 described later), the cover film 51, an RFID label Tape 28 with print, and a used ink ribbon 52 (refer to FIG. 3 described later), and are rotationally driven in coordination.

On the other hand, the cartridge 21 has a box shape that is generally formed into a rectangular solid, with a head insertion opening 22 that passes through the front and rear surfaces formed on a part thereof.

The peripheral components of the cartridge 21 and the cartridge holder 8 will now be described with reference to FIG. 3. Note that FIG. 3 corresponds to the arrow view of the structure shown in FIG. 1 as viewed from the arrow A, with the opening/closing lid 3 removed.

Figure 3:
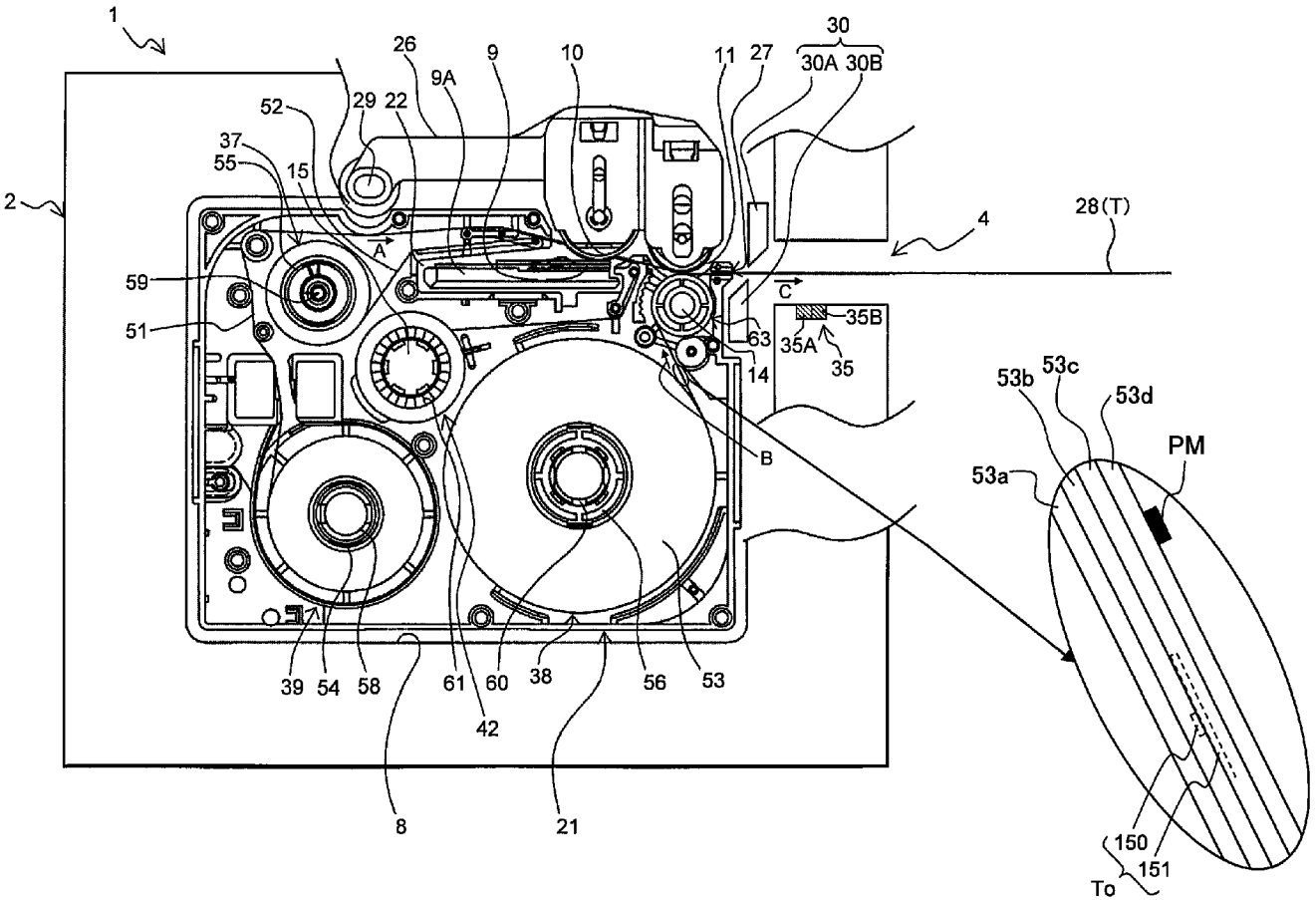
FIG. 3 is a diagram illustrating the area surrounding the cartridge holder with a cartridge mounted, along with the cartridge.

In FIG. 3, the cartridge 21 is detachably housed (mounted) in the cartridge holder 8. The cartridge 21 comprises a tag tape roll 38, a cover film roll 39, a ribbon supply-side roll 37, a ribbon take-up roller 42, and a tape feeding roller 63.

The tag tape roll 38 comprises the tag tape 53 wound around the periphery of a tag tape spool 56.

The tag tape 53 comprises a layered structure of a plurality of layers (four layers in this example; refer to the partially enlarged view in FIG. 3). That is, the tag tape 53 is designed with layers comprised of an adhesive layer 53*a* made of a suitable adhesive for bonding the cover film 51 described later, a tape base layer 53*b* made of PET (polyethylene terephthalate) or the like, an adhesive layer 53*c* made of a suitable adhesive, and a separation sheet 53*d*, which are layered from the side wrapped on the inside (the left side in FIG. 3) to the opposite side (the right side in FIG. 3).

Figure 7A:
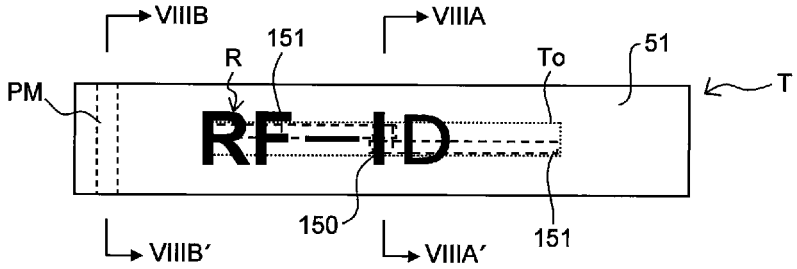
FIG. 7 is a top plan view and a bottom plan view illustrating the appearance of an exemplary RFID label.
Figure 7B:
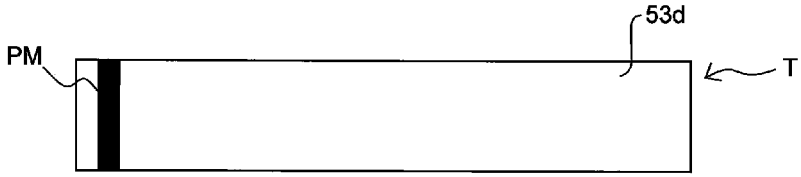
Figure 8A:
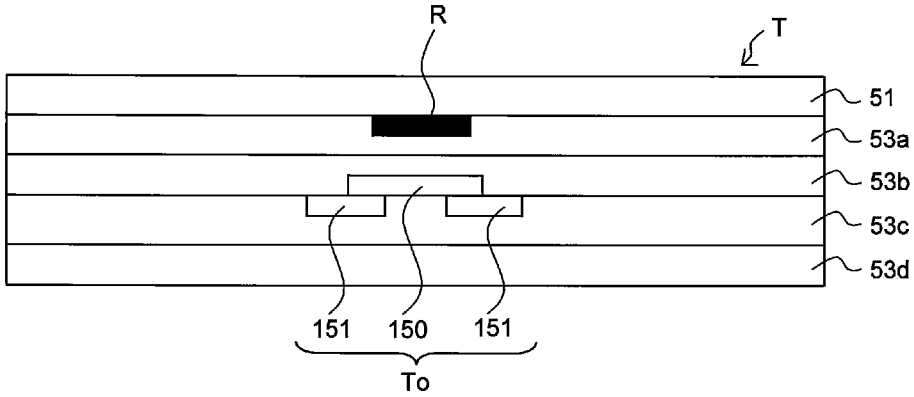
FIG. 8 is a cross-sectional view of the cross-section along line VIIIA-VIIIA' in FIG. 7A rotated 90 degrees, and a cross-sectional view of the cross-section along line VIIIB-VIIIB' in FIG. 7A rotated 90 degrees.
Figure 8B:
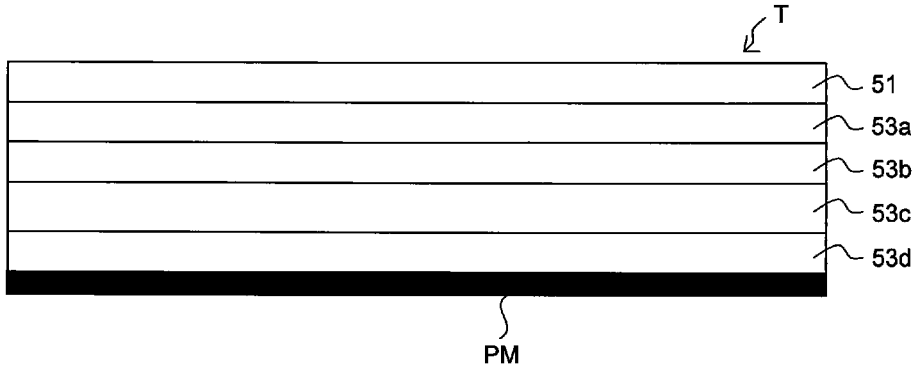

The separation sheet 53*d* is peeled off when an RFID label T (refer to FIG. 7, etc., described later) eventually formed is to be affixed to an object such as a predetermined article, thereby making it possible to adhere the RFID label T to the article or the like by the adhesive layer 53*c*.

A tag antenna 151 that performs information transmission and reception is integrally provided to the rear side (right side in FIG. 3) of the tape base layer 53*b*. In addition, an IC circuit part 150 that stores information is formed so that it connects to this tag antenna 151. An RFID circuit element To is formed by the IC circuit part 150 and the tag antenna 151.

A light-absorbing black mark PM is provided by printing on the rear surface (the surface of one side of the tag tape 53; the right side in FIG. 3) of the separation sheet 53*d*.

The cover film roll 39 comprises the cover film 51 having substantially the same width as the tag tape 53 that is wrapped around a cover film spool 54.

The ribbon supply-side roll 37 is a roll that feeds out the ink ribbon 52 for printing (not required when the print-receiving medium is a thermal tape), and the ink ribbon 52 is wrapped around the periphery of a ribbon supply-side spool 55.

Note that the above-described tag tape spool 56, the cover film spool 54, and the ribbon supply-side spool 55 rotatably fit and are stored on a boss 60, a boss 58, and a boss 59 provided on the bottom surface of the cartridge 21.

The ribbon take-up roller 42 comprises a ribbon take-up spool 61. This ribbon take-up roller 42 is driven by the ribbon take-up roller driving shaft 15 on the side of the cartridge holder 8, thereby winding the printed (used) ink ribbon 52 around the ribbon take-up spool 61.

The feeding roller 63 is configured to affix the tag tape 53 and the cover film 51 to each other by applying pressure, and feeds the RFID label Tape 28 with print thus formed in the directions of arrows A, B, and C in FIG. 3 (i.e. functioning as a tape pressure roller as well), when driven by the above-described feeding roller driving shaft 14 on the side of the cartridge holder 8.

The above-described ribbon take-up roller 42 and the feeding roller 63 are rotationally driven in coordination by the driving power of a feeding motor 32 (refer to FIG. 4 described later), which is a pulse motor, for example, provided on the outside of each of the cartridges 21. This driving power is transmitted to the above-described ribbon take-up roller driving shaft 15 and the feeding roller driving shaft 14 via a gear mechanism (not shown).

On the other hand, the above-described print head 9, the heat sink 9A, the ribbon take-up roller driving shaft 15, the feeding roller driving shaft 14, and a roller hold 26 are provided on the cartridge holder 8.

The print head 9 comprises a plurality of heat emitting elements, and performs desired printing in a predetermined print area (not shown) of the cover film 51 fed out from the above-described cover film roll 39.

The feeding roller driving shaft 14 feeds the tag tape 53 supplied from the tag tape roll 38, the cover film 51 supplied from the cover film roll 39, and the RFID label Tape 28 with print along the feeding path (refer to the arrows A, B, and C in the figure) and toward the discharging exit 4 when driven by the feeding roller 63. Note that the tag tape 53, the cover film 51, and the RFID label Tape 28 with print will suitably be abbreviated and referred to as "tag tape 53, etc." hereinafter.

The roller holder 26 is rotatably supported by a support shaft 29 and can switch between a printing position and a release position via a switching mechanism. A platen roller 10 and a tape compression roller 11 are rotatably provided on this roller holder 26. Then, when the roller holder 26 switches to the above-described printing position, the platen roller 10 and the tape compression roller 11 are pressed against the above-described print head 9 and the feeding roller 63.

Furthermore, a cutter unit 30 (a scissor type in this example) is provided adjacent to a label tape discharging exist 27 of the cartridge 21 in the tag label producing apparatus 1. This cutter unit 30 comprises a movable blade 30A and a fixed blade 30B. Then, the movable blade 30A operates with respect to the fixed blade 30B by a solenoid 34 (refer to FIG. 4 described later), cutting the RFID label Tape 28 with print that was printed by the above-described print head 9 at a desired length to form an RFID label T.

The discharging exit 4 is formed so that the discharging direction of the RFID label T cut by the above-described cutter unit 30 (or the RFID label Tape 28 with print prior to cutting) is substantially horizontal along the installation surface H of the tag label producing apparatus 1.

In the example of this embodiment, a mark sensor 35 is provided between the above-describe cutter unit 30 and the tape discharging exit 4, that is, on the feeding path facing the tape discharging exit 4 downstream in the tape feeding direction (on the right side in the figure) from the cutter unit 30.

The mark sensor 35 is an optical sensor used in optical techniques, such as a known reflective sensor, for example. That is, the mark sensor 35 comprises a light projecting device 35A and a light receiving device 35B. The light projecting device 35A projects light toward the tag tape 53, etc. The light receiving device 35B receives the reflected light emitted from the above-described light projecting device 35A and reflected from the tag tape 53, etc., and outputs the voltage corresponding to the received amount of light. (The detailed configuration of the mark sensor 35 will be described later with reference to FIG. 5.)

With the above-described configuration, once the cartridge 21 is mounted to the cartridge holder 8, the ribbon take-up roller driving shaft 15 and the feeding roller driving shaft 14 are simultaneously rotationally driven by the driving power of the above-described feeding motor 32. The feeding roller 63, the platen roller 10, and the tape pressure roller 11 rotate in accordance with the drive of the feeding roller driving shaft 14, thereby feeding out the tag tape 53 from the tag tape roll 38 and supplying the tag tape 53 to the feeding roller 63 as described above. On the other hand, the cover film 51 is fed out from the cover film roll 39 and power is supplied to the plurality of heat emitting elements of the print head 9 by a print-head driving circuit 31 (refer to FIG. 4 described later). At this time, the ink ribbon 52 is pressed against the print head 9 and made to come in contact with the rear surface of the cover film 51. As a result, the desired printing (mirror image printing) is performed in the predetermined print area on the rear surface of the cover film 51. Then, the tag tape 53 and the cover film 51 on which the above-described printing is completed are adhered and integrated by the feeding roller 63 and the tape compression roller 11 to form the RFID label Tape 28 with print. The tag label tape 28 with print thus formed is fed out from the above-described label tape discharging exit 27 to the outside of the cartridge 21. The RFID label Tape 28 with print is then cut by the cutter unit 30 to form the RFID label T on which desired printing was performed.

The functional configuration of the tag label producing apparatus 1 will now be described with reference to FIG. 4.

Figure 4:
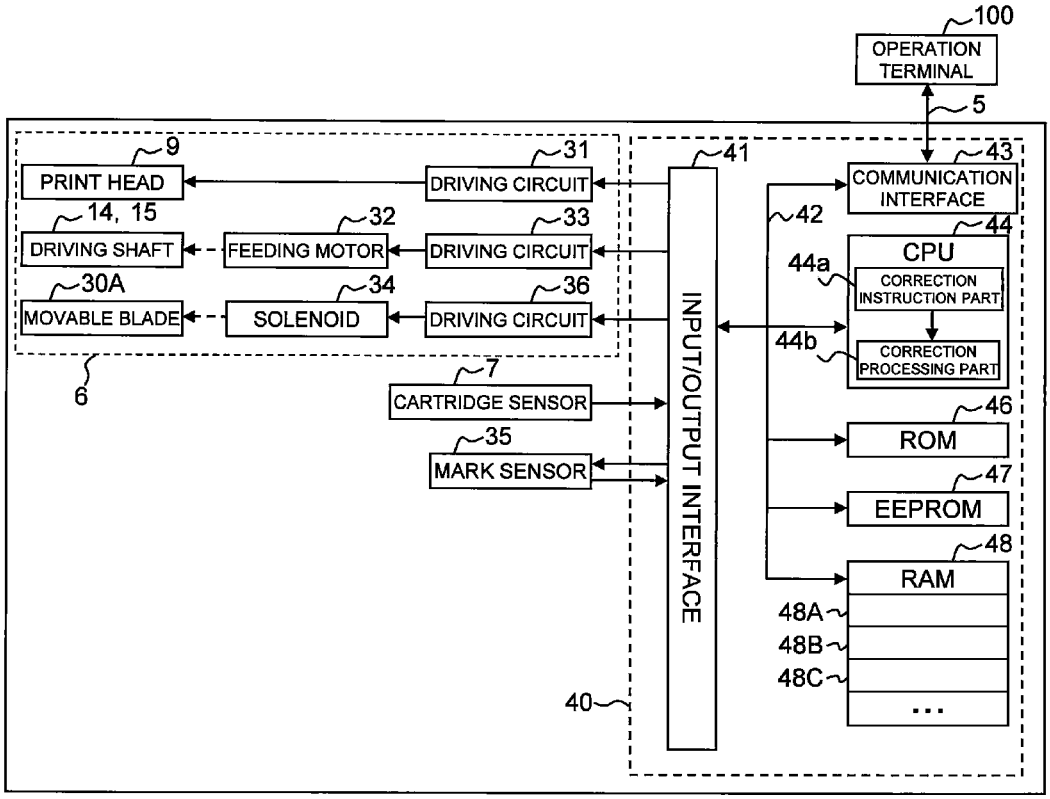
FIG. 4 is a functional block diagram which shows the functional configuration of the tag label producing apparatus.

In FIG. 4, a control circuit 40 is disposed on a control board (not shown) of the tag label producing apparatus 1. The control circuit 40 is provided with a CPU 44, which is connected to an input/output interface 41, a ROM 46, an EEPROM 47, a RAM 48, and a communication interface 43, via the data bus 42. Note that flash memory may be used in place of the EEPROM 47.

Various programs required for control, such as a print drive control program and a cutting drive control program, are stored on the ROM 46. The print drive control program is a program for reading the data of a print buffer 48B described later and driving the above-described print head 9 and the feeding motor 32 described later. The cutting drive control program is a program for driving the feeding motor 32 to feed the RFID label Tape 28 with print when printing is completed to the cutting position, and driving the solenoid 34 described later to cut the RFID label Tape 28 with print. The CPU 44 performs various operations and processing based on such various programs stored in the ROM 46.

The CPU 44 comprises a correction instruction part 44*a* and a correction processing part 44*b* in its interior. As described in detail later, the correction instruction part 44*a* issues a correction instruction signal to the above-described correction processing part 44*b* at a predetermined time when the above-described light projecting device 35A is in an off state and external light from the discharging exit 4 can enter the interior of the apparatus main body 2. The correction processing part 44*b* calculates a predetermined unique setting value (described later) stored in advance in the above-described EEPROM 47 when the correction instruction signal is inputted from the above-described correction instruction part 44*a*, and a corrected threshold value Vr (described later) using a detected voltage value V1 (described later) detected by the above-described light receiving device 35B when the correction instruction signal is issued. The CPU 44 thus performs various calculations and processing, including in particular processing related to the calculation of the corrected threshold value Vr that is performed in coordination with the correction instruction part 44*a* and the correction processing part 44*b*.

The RAM 48 temporarily stores the results of various operations performed by the CPU 44. This RAM 48 is provided with devices such as a text memory 48A, the print buffer 48B, and a work memory 48C. The text memory 48A stores print data. The print buffer 48B stores dot pattern data. The work memory 48C stores various calculation data and the like.

The communication interface 43 comprises, for example, a USB (Universal Serial Bus), etc., and performs information communication (serial communication, for example) via the cable 5 with the operation terminal 100.

The print-head driving circuit 31, a feeding motor driving circuit 33, a solenoid driving circuit 36, a cartridge sensor 7, and the above-described mark sensor 35 are connected to the input/output interface 41.

The print-head driving circuit 31 drives the print head 9.

The feeding motor driving circuit 33 drives the feeding motor 32, thereby driving the aforementioned feeding roller driving shaft 14 and the ribbon take-up roller driving shaft 15, feeding the tag tape 53, etc.

The solenoid driving circuit 36 drives the solenoid 34 configured to drive the movable blade 30A to perform the cutting operation.

The print-head driving circuit 31, the print head 9, the feeding motor driving circuit 33, the feeding motor 32, the feeding roller driving shaft 14, the ribbon take-up roller driving shaft 15, the solenoid driving circuit 36, the solenoid 34, and the movable blade 30A, etc., make up a thermal printing mechanism 6 capable of continually producing the RFID label T using the cut RFID label Tape 28 with print.

The cartridge sensor 7 is provided to the cartridge holder 8, for example. Then, the cartridge sensor 7 detects the type of the cartridge 21 by detecting a detected part (not shown) formed on the cartridge 21 when mounted to the cartridge holder 8 of the cartridge 21.

The mark sensor 35 detects the above-described black mark PM based on the reflection behavior of the reflected light as described above. Note that this mark sensor 35 is capable of switching the above-described light projecting device 35A from on to off based on the control of the above-described CPU 44. The CPU 44 detects the black mark PM of the above-described separation sheet 53*d* based on the detected value, that is, a detected voltage value V, outputted from the above-described light receiving device 35B in accordance with the reflected light received by the above-described light receiving device 35B (details will be described later).

In the control system in which the control circuit 40 shown in FIG. 4 serves as the core, print data is stored in the text memory 48A when that print data is inputted via the cable 5 from the operation terminal 100. The stored print data are read once again and subjected to predetermined conversion by the converting function of the control circuit 40, thereby generating dot pattern data. This data is then stored in the print buffer 48B. Then, the print head 9 is driven via the print-head driving circuit 31 and the above-described heating elements are selectively thermally driven in accordance with the print dots of one line, printing the dot pattern data stored in the print buffer 48B. At the same time, the feeding motor 32 controls the feeding of the tag tape 53, etc., via the feeding motor driving circuit 33, eventually producing the RFID label T.

Figure 5:
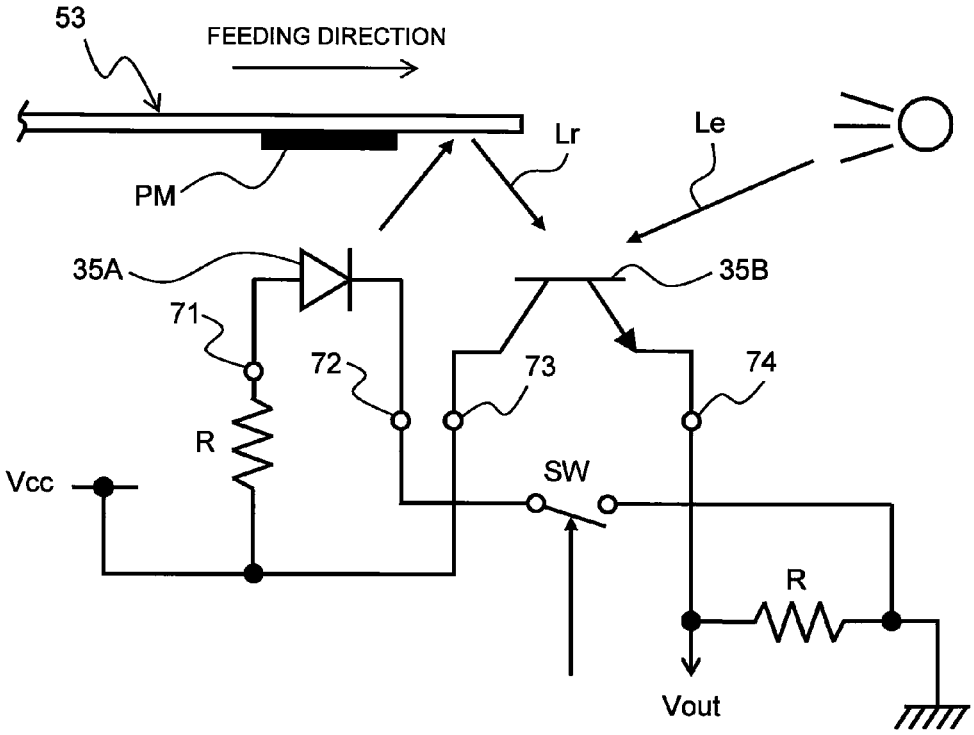
FIG. 5 is a diagram illustrating a circuit configuration of a mark sensor.

The detailed circuit configuration of the mark sensor 35 will now be described with reference to FIG. 5. In FIG. 5, the mark sensor 35 comprises the aforementioned light projecting device 35A and the light receiving device 35B as well as a switch SW and a bias resistor R. The light projecting device 35A in this example is made of a light-emitting diode, with an anode terminal 71 thereof connected to a power source (power source voltage Vcc) and a cathode terminal 72 thereof connected via the switch SW. The light receiving device 35B of this example is made of a phototransistor, with a collector terminal 73 thereof connected to the power source and an emitter terminal 74 thereof serving as an output terminal that outputs the detected voltage value V and is grounded via the bias resistor R. In this example, the mechanical layout is designed so that the light projecting device 35A and the light receiving device 35B are arranged in that order along the feeding direction of the tag tape 53, etc.

In the mark sensor 35 of such a configuration, the switch SW is connected and disconnected based on the control of the above-described CPU 44 via the above-described input/output interface 41, controlling the on and off switching the light projecting device 35A. Then, the light receiving device 35B receives a reflected light Lr via the tag tape 53, etc., when the above-described light projecting device 35A turns on, and an external light Le described later that enters from the outside of the apparatus main body 2, and outputs the detected voltage value V of a level corresponding with the total received amount of light. In this example, the phototransistor that makes up the light receiving device 35B is biased on the side of the emitter, thereby outputting the detected voltage value V at a level that increases in proportion to the above-described total received amount of light (refer to FIG. 11 described later).

Figure 6:
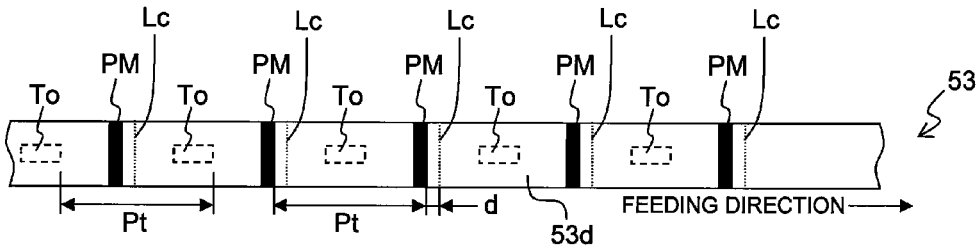
FIG. 6 is an explanatory view conceptually illustrating the configuration of a tag tape.

Next, the structure of the tag tape 53 will now be conceptually described with reference to FIG. 6. FIG. 6 shows a mid-section of the tag tape 53 in the feeding direction.

In FIG. 6, the above-described RFID circuit element To of a predetermined quantity (40 in this example) is disposed on the tag tape 53 at a predetermined fixed pitch Pt (10 cm interval, for example) along the feeding direction thereof. The above-described black mark PM is printed at the fixed pitch Pt equivalent to the disposed interval of the above-described RFID circuit element To on the rear surface (the front in FIG. 6) of the separation sheet 53*d* of the tag tape 53, along the tape width direction of the tag tape 53, in accordance with the disposed position of the above-described RFID circuit element To.

In the tag tape 53, a planned cutting line Lc to be cut by the above-described cutter unit 30 is also disposed at the fixed pitch Pt equivalent to the disposed interval of the above-described RFID circuit element To and, in this example of the embodiment, is positioned away from the above-described black mark PM on the downstream side of the tape feeding direction by a predetermined distance d.

An example of the outer appearance of the RFID label T formed as described above will now be described with reference to FIG. 7A, FIG. 7B, FIG. 8A, and FIG. 8B.

In FIG. 7A, FIG. 7B, FIG. 8A and FIG. 8B, the RFID label T has a five layer structure with the cover film 51 added to the tag tape 53 shown in the aforementioned FIG. 3. That is, the RFID label T is designed with layers comprised of the cover film 51, the adhesive layer 53*a*, the tape base layer 53*b*, the adhesive layer 53*c*, and the separation sheet 53*d*, which are layered in that order from the front surface (upper side in FIG. 8A and FIG. 8B) to the opposite side (lower side in FIG. 8A and FIG. 8B).

The RFID circuit element To comprising the IC circuit part 150 and the tag antenna 151 is provided to the rear side (the lower side in FIG. 8A and FIG. 8B) of the tape base layer 53*b* as previously described. The black mark PM is printed along the tape width direction on the rear surface of the separation sheet 53*d*. Note that, in this example, the above-described separation sheet 53*d* is made of a color or material capable of reflecting light at a sufficiently high reflection rate.

Print R (the letters "RF-ID" in this example) is printed by mirror image printing on the rear surface of the cover film 51.

Note that while this example shows a case where the tag antenna 151 is a so-called dipole antenna, the present disclosure is not limited thereto, allowing the tag antenna 151 to be a so-called loop antenna.

The functional configuration of the RFID circuit element To will now be described with reference to FIG. 9.

Figure 9:
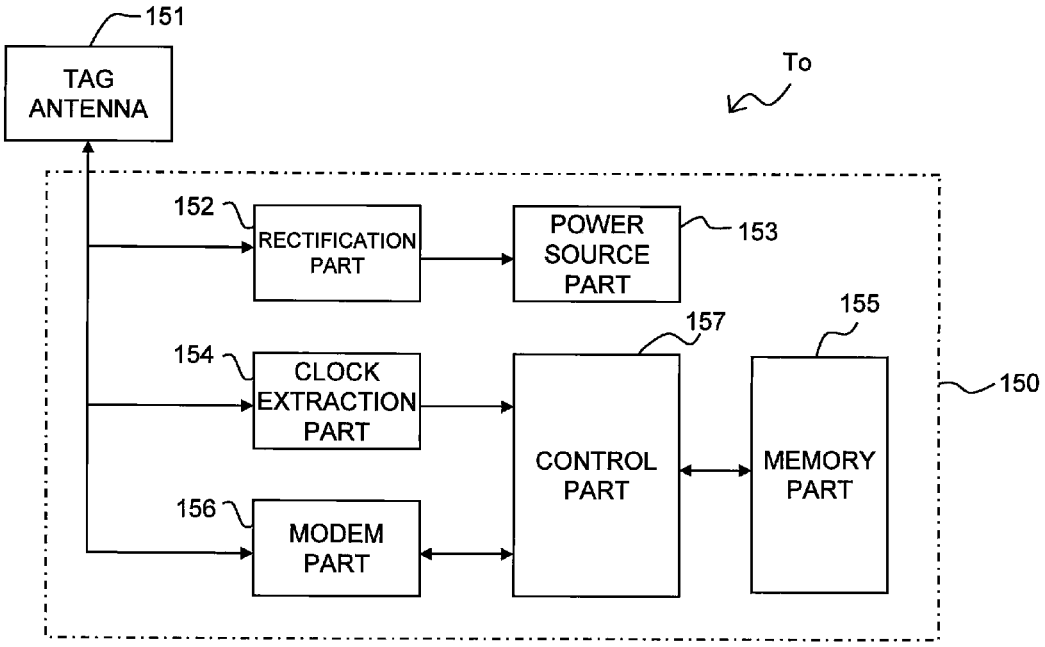
FIG. 9 is a functional block diagram which shows the functional configuration of an RFID circuit element.

In FIG. 9, the IC circuit part 150 comprises a rectification part 152, a power source part 153, a clock extraction part 154, a memory part 155, a modem part 156, and a control part 157.

The rectification part 152 rectifies the interrogation wave received via the tag antenna 151. The power source part 153 stores the energy of the interrogation wave thus rectified by the rectification part 152 as a power source of the RFID circuit element To. The clock extraction part 154 extracts a clock signal from the interrogation wave thus received from the tag antenna 151 and supplies the clock signal thus extracted to the control part 157. The memory part 155 stores a predetermined information signal.

The modem part 156 demodulates the interrogation wave from known information scanning device (not shown) received from the tag antenna 151. The modem part 156 also modulates and returns from the tag antenna 151 as a response wave, that is, a signal that includes tag identification information, the response signal from the control part 157.

The control part 157 controls the operation of the RFID circuit element To via the above-described memory part 155, clock extraction part 154, the modem part 156, and the like. In addition, the control part 157 interprets a received signal demodulated by the modem part 156, and generates a response signal based on the information signal stored in the memory part 155. Then, the control part 157 sends the response signal via the tag antenna 151.

Next, the positional relationship between the main components of this embodiment, that is, the mark sensor 35 and the tag tape 53 of the production process of the RFID label T, and the light projection and reception behavior of the mark sensor 35 will be described with reference to FIG. 10.

Figure 10A:
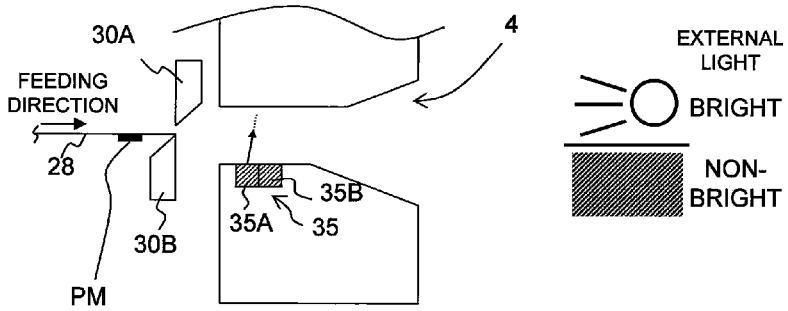
FIG. 10 is a diagram illustrating the positional relationship between the mark sensor and tag tape in each stage of the process of producing an RFID label.

First, prior to the start of the production operation of the RFID label T, the front end of the tag tape 53, etc., is positioned upstream in the tape feeding direction from the cutter unit 30, as illustrated in FIG. 10A. As a result, the tag tape 53, etc., does not exist within the detected range of the mark sensor 35 disposed downstream from the cutter unit 30 in the tape feeding direction. At this time, there is no direct reflection from the tag tape 53, etc., even when the light projecting device 35A is turned on, resulting in a very low amount of reflected light Lr received by the light receiving device 35B.

Next, when the label production instruction signal for producing the RFID label T is inputted from the operation terminal 100 into the tag label producing apparatus 1 via the cable 5, production of the RFID label T is started by the aforementioned thermal printing mechanism 6 (refer to FIG. 4). That is, first the feeding of the tag tape 53, etc., is started by the feeding roller 63, etc., based on the driving power of the feeding roller driving shaft 14, etc. (refer to FIG. 3).

Figure 10B:
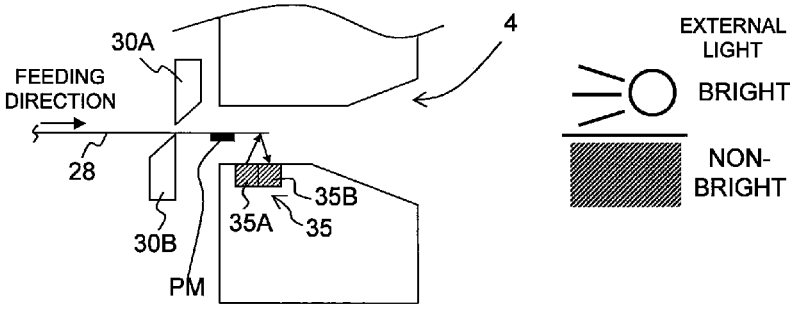

Then, once the feeding of the tag tape 53, etc., is started, the tag tape 53, etc., is fed out from the above-described label tape discharging exit 27 (refer to FIG. 3). With this arrangement, the front end section of the tag tape 53, etc., arrives within the predetermined detection range of the mark sensor 35, as illustrated in FIG. 10B. At this time, first the reflected light Lr reflected from the white section between the planned cutting line (front end position of the tag tape 53, etc.) Lc and the black mark PM of the above-described FIG. 7 is initially received by the light receiving device 35B.

Figure 10C:
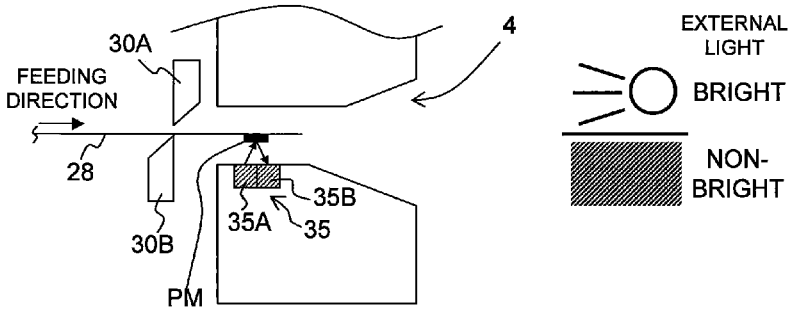

Subsequently, when the tag tape 53, etc., is further fed toward the tape discharging exit 4 based on the driving power of the feeding roller driving shaft 14, etc., the above-described black mark PM arrives within the above-described detection range of the mark sensor 35. As a result of the behavior at this time, the existence of this black mark PM is then detected by the mark sensor 35 as illustrated in FIG. 10C.

That is, light is emitted from the above-described light projecting device 35A and then the intensity of the reflected light Lr of the above-described light received by the above-described light receiving device 35B becomes lower than the predetermined threshold value (described later) due to the light absorbency of the black mark PM. As a result, the existence of the black mark PM is detected.

When the black mark PM is thus detected by the mark sensor 35, the tag tape 53, etc., is fed a predetermined distance based on the timing of this detection, and printing in the print area of the cover film 51 by the print head 9 is started.

Subsequently, when the tag tape 53, etc., is fed a predetermined distance, such as a feeding distance whereby the entire print area of the cover film 51 passes the cutter unit 30 by a predetermined distance downstream, based on the driving power of the feeding roller driving shaft 14, etc., the feeding is stopped. Then, the printed tag tape 53, etc., that is, the RFID label Tape 28 with print, is cut (separated) by the cutter unit 30 to form the RFID label T. Printing control and feeding control of the tag tape 53, etc., after feeding is started are thus performed based on the detection timing of the black mark PM by the mark sensor 35.

Note that the external light Le (refer to the above-described FIG. 5) may enter the apparatus main body 2 from the discharging exit 4 of the apparatus main body 2 depending on the format of use of the user, such as indoor or outdoor use in a bright location, for example, affecting detection of the black mark PM by the above-described mark sensor 35. While in prior art the black mark PM is detected by a significant decrease in the received amount of light of the light receiving device 35B and resulting significant decrease in the detected voltage value V caused by the nature of the light absorbency of the black mark PM as described above, the decreasing behavior of the amount of light received by the light receiving device 35B caused by the black mark PM is alleviated by the external light Le when the above-described external light Le enters. That is, the amount of decrease in the aforementioned detected voltage value V decreases, causing a decrease in the fluctuation width of the detected voltage value V. As a result, the amount of received light does not decrease below the above-described predetermined threshold value even when light is projected on the black mark PM, causing potential difficulties in detection of the black mark PM.

Here, according to the embodiment, in the production process of the RFID label T that includes the above-described states of FIG. 10A, FIG. 10B, and FIG. 10C, a normal threshold value (=initial threshold value) set in advance under the premise that the external light Le has not entered is corrected to a value (=corrected threshold value) corresponding to a case where the external light Le has entered, thereby making highly accurate detection of the black mark PM possible. The principle of threshold value correction that takes into consideration the effects of the above-described external light Le will now be described with reference to FIG. 11.

Figure 11:
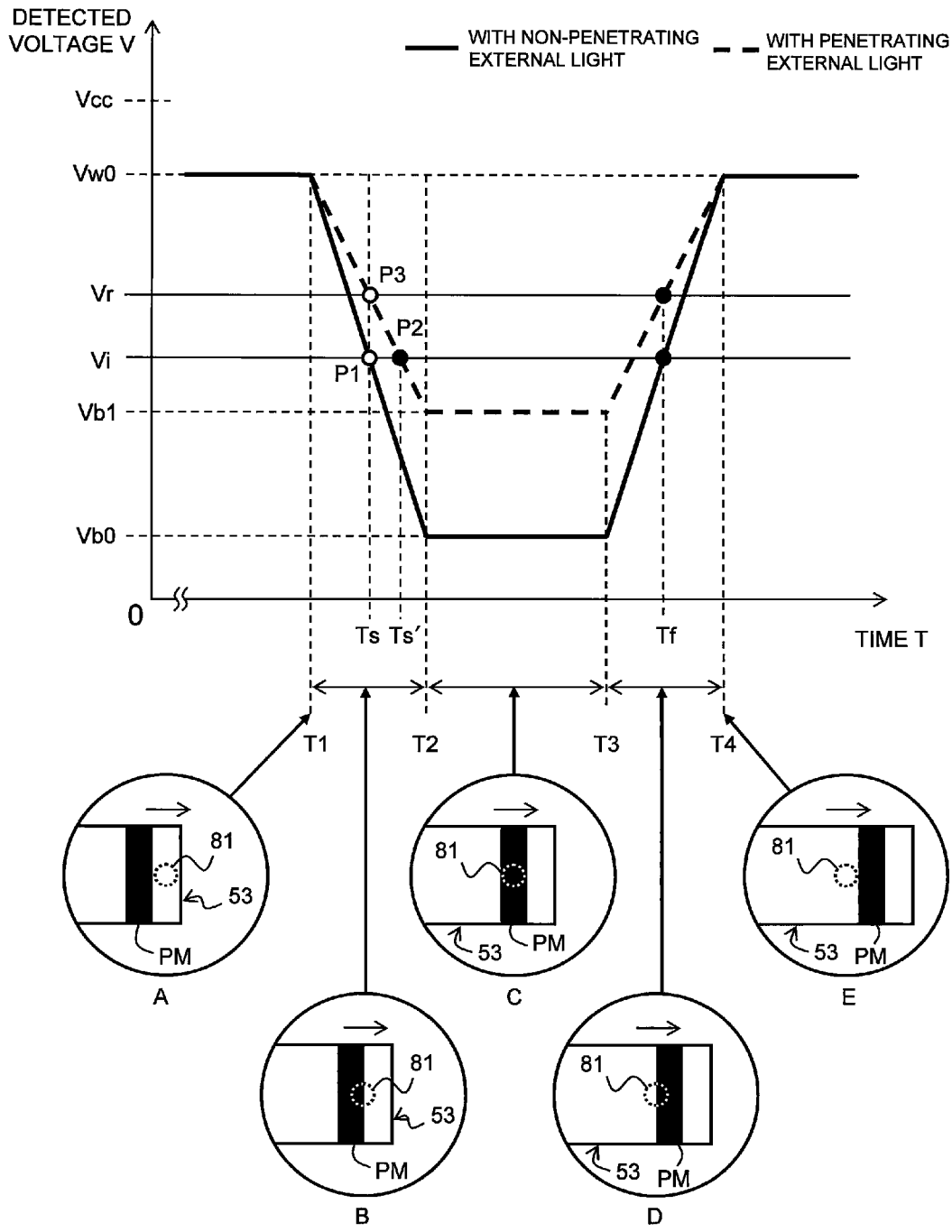
FIG. 11 is a time chart showing the change in the detected voltage value before and after the mark sensor detects the black mark, along with a schematic diagram of the positional relationship of the black mark and the light projection range of the light projecting device.

The time chart shown in FIG. 11 shows a time T on the horizontal axis and the above-described detected voltage V from the light receiving device 35B on the vertical axis. Note that the light projecting device 35A is always in an on state within the entire range of time shown in the chart, and a light projection range 81 in sections A to E is shown larger than its actual size for convenience of illustration.

(a) Behavior when not Affected by External Light

In FIG. 11, the bold line shows a time chart of a case when the external light Le does not enter, that is, when the area surrounding the tag label producing apparatus 1 is sufficiently dark. Immediately after the feeding of the tag tape 53, etc., is started based on a label production instruction signal (when T<T1), a light projection range 81*h* of the light projecting device 35A is positioned in the margin section at the front end of the tag tape 53, etc., as previously described with reference to FIG. 10B (refer to Section A in FIG. 11). In this case, the output voltage value V from the light receiving device 35B is a high initial white voltage value Vw0. Note that this initial white voltage value Vw0 is a voltage value that is close to a power source voltage value Vcc supplied by the power source in the above-described FIG. 5, and is set in advance (to the value detected prior to factory shipment, for example) taking into consideration the variance in sensor element characteristics.

Subsequently, when the feeding of the tag tape 53, etc., advances as previously described, the light projection range 81 of the light projecting device 35A starts to overlap with the black mark PM based on a certain timing (T=T1). Then, as the feeding of the tag tape 53, etc., advances, the range in which the black mark PM and the light projection range 81 overlap increases (refer to Section B in FIG. 11). Since the black mark PM has light absorbency, the received amount of reflected light Lr of the light receiving device 35B decreases as the range of overlap of the black mark PM and the light projection range 81 increases, as previously described with reference to FIG. 10B. As a result, when T becomes greater than T1, the detected voltage value V decreases, sloping downward and to the right from the above-described initial white voltage value Vw0.

Subsequently, when the feeding of the tag tape 53, etc., advances further, the light projection range 81 of the light projecting device 35A completely overlaps the black mark PM based on a certain timing (T=T2) as previously described with reference to FIG. 10C (refer to Section C in FIG. 11). In this state, the detected voltage value V that had decreased as described above stops decreasing and becomes an initial black voltage value Vb0. Note that this initial black voltage value Vb0 is also set in advance at the time of factory shipment, for example, similar to the above-described initial white voltage value Vw0. This state is subsequently maintained until time passes and T=T3 (described later).

Subsequently, when the feeding of the tag tape 53, etc., advances further as previously described, the light projection range 81 of the light projecting device 35A starts to move outside the black mark PM based on a certain timing (T=T3). Then, as the feeding of the tag tape 53, etc., advances, the range in which the black mark PM and the light projection range 81 overlap decreases (refer to Section D in FIG. 11). With this decrease in the overlapping range of the black mark PM and light projection range 81, the received amount of reflected light Lr of the light receiving device 35B increases. As a result, when T becomes greater than T3, the detected voltage value V increases, sloping upward and to the right from the above-described initial black voltage value Vb0.

Subsequently, when the feeding of the tag tape 53, etc., advances further, the light projection range 81 of the light projecting device 35A is completely away from the black mark PM based on a certain timing (T=T4; refer to Section D in FIG. 11). As a result, the detected voltage value V that had increased as previously described returns to the aforementioned initial white voltage value Vw0.

(b) Behavior when Affected by External Light

On the other hand, in FIG. 11, the dashed line indicates a time chart when the external light Le enters. In the aforementioned range in which T≤T1 immediately after the feeding of the tag tape 53, etc., is started based on a label production instruction signal, the detected voltage V from the light receiving device 35B becomes the initial white voltage value Vw0 of the same level as without entry of the external light Le. This is because the sections of the separation sheet 53*b* other than the black mark PM are white (or with a mirror surface), which is capable of reflecting light at a sufficiently high reflection rate, causing the light receiving device 35B to receive the reflected light Lr in a sufficiently high amount, regardless of whether the external light Le has entered or not entered.

Subsequently, within the range of T1≤T≤T2, the detected voltage value V decreases, sloping downward and to the right, similar to the above-described case when the external light Le does not enter. Note, however, that the decreasing behavior of the detected voltage value V caused by the effect of the external light Le when this external light Le enters is alleviated as previously described, making the downward slope to the right a gentle slope (decreasing the rate of decrease of the voltage value V). As a result, the value at which T=T2 and the detected voltage value V stops decreasing is a value Vb1 (hereinafter suitable referred to as the true black voltage value) that is greater than the initial black voltage value Vb0 in the aforementioned case where the aforementioned external light Le does not enter. In the range T2≤T≤T3, the detected voltage value V is maintained at this true black voltage value Vb1, similar to the case where the above-described external light Le does not enter.

Subsequently, within the range of T3≤T≤T4, the detected voltage value V increases, sloping upward and to the right, similar to the case where the external light Le does not enter. Note, however, that the increasing behavior of the detected voltage value V caused by the effect of the external light Le when this external light Le enters is alleviated, making the upward slope to the right a gentle slope (decreasing the rate of increase of the voltage value V). Then, when T=T4, the detected voltage value V that had increased returns to the aforementioned initial white voltage value Vw0.

As is clear from the above explanation, the fluctuation width (the above-described initial white voltage value Vw0 to the true black voltage value Vb1) of the detected voltage value V caused by the existence of the black mark PM when the external light Le enters becomes lower than the fluctuation width (the above-described initial white voltage value Vw0 to the initial black voltage value Vb0) of the detected voltage value V caused by the existence of the black mark PM when the external light Le does not enter. In this example, the fluctuation width of the detected voltage value V is reduced from "Vw0−Vb0" to "Vw0−Vb1."

(c) Setting the Threshold Value (c-1) Initial Setup of the Threshold Value

In the tag label producing apparatus 1 of this embodiment, the fluctuation (Initial white voltage value Vw0→Initial black voltage value Vb0→Initial white voltage value Vw0) of the detected voltage value V caused by the existence of the black mark PM as described above is used to detect that the black mark PM has arrived at a position opposite the mark sensor 35, thereby detecting position of the tag tape 53, etc., in the feeding direction. Specifically, a threshold value (hereinafter simply referred to as the initial threshold value) Vi associated with the detected voltage value V is set in advance at the time of factory shipment, for example. This initial threshold value Vi is set between the above-described initial white voltage value Vw0 and the above described initial black voltage value Vb0 in accordance with the behavior indicated by the above-described solid line, based on the following equation, where k (hereinafter suitably referred to as "threshold coefficient") is a value less than 1:

$$Vi=Vb0+k(Vw0-Vb0) \quad \text{(Equation 1)}$$

As is clear from Equation 1, given an interval 1 from Vw0 to Vb0, which is the fluctuation width of the detected voltage value V, this initial threshold value Vi applies k times the interval length from Vw0 to Vb0 to divide the above-described interval. With this arrangement, the detected voltage value V decreases in the above-described range of T1≤T≤T2 when the external light Le does not enter, making it possible to detect the black mark PM in a position opposite the mark sensor 35 when V=Vi (refer to timing point P1 of T=Ts shown in FIG. 11). Note that the values of the above-described initial white voltage value Vw0, the initial black voltage value Vb0, the initial threshold value Vi, and the threshold coefficient k are stored in advance in the EEPROM 47 of the above-described control circuit 40.

(c-2) Necessity for Threshold Value Correction

Here, when the external light Le enters, the fluctuation range of the detected voltage value V caused by the existence of the black mark PM decreases as described above, causing the true black voltage value Vb1 to become larger than the initial black voltage value Vb0 of the case where the external light Le does not enter. As a result, depending on the amount of light of the external light Le, the above-described true black voltage value Vb1 having a minimum fluctuation width may become larger than the above-described predetermined initial threshold value Vi. In such a case, based on the behavior shown by the dashed line previously described, the existence of the black mark PM can no longer be detected since V=Vi is not achieved even when the detected voltage value V decreases, sloping downward and to the right, in the range T1≤T≤T2, due to the existence of the black mark PM.

Even in a case where the true black voltage value Vb1 is lower than the initial threshold value Vi (refer to FIG. 11), the rate of decrease of the detected voltage value V in the range T1≤T≤T2 decreases as previously described, causing the timing at which V=Vi to become time Ts', which is shifted from the above-described time Ts of the case where the external light Le does not enter (refer to point P2 in FIG. 11). That is, the mark sensor 35 exhibits a shift in the timing at which it detects the black mark PM depending on the presence or non-presence of the external light Le, causing a decrease in the accuracy of the feeding control and printing control of the tag tape 53, etc., in the tag label producing apparatus 1.

(c-2) Correcting the Threshold Value

In the tag label producing apparatus 1 of this embodiment, the corrected threshold value Vr is used in place of the above-described initial threshold value Vi predetermined in advance by Equation 1 in order to accommodate the entry of the external light Le in view of the above. This corrected threshold value Vr is calculated in this embodiment using the following equation:

$$Vr=V1+k(Vw0-V1) \quad \text{(Equation 2)}$$

V1 is the value of the detected voltage value V actually outputted from the light receiving device 35B when the label producing apparatus 1 produces the RFID label T, and is a value that includes the effects of the external light Le when the external light Le enters. In this embodiment, this value is the detected voltage value from the light receiving device 35B at a predetermined time when the light projecting device 35A is in an off state and the external light Le can enter the interior of the apparatus main body 2 from the discharging exit 4, as described later. Since the light projecting device 35A is in an off state, the amount of light received by the light receiving device 35B is simply the light corresponding to the external light Le that actually enters. That is, the detected voltage value V from the light receiving device 35B changes within a fluctuation range having a minimum value equivalent to the detected voltage value V1 of the light receiving device 35B with the external light Le present, and a maximum value equivalent to the aforementioned initial white voltage value Vw0.

As a result, as is clear from Equation 2, the corrected threshold value Vr is based on the same technical principle as the previously described setting of the above-described initial threshold value Vi and is equivalent to a voltage value that, given an interval 1 from Vw0 to V1, which is the fluctuation width of the detected voltage value V when the aforementioned external light Le enters, applies k times the interval length to divide the above-described interval. Calculating the corrected threshold value Vr using the same threshold coefficient k as the initial threshold value Vi in this manner corrects the threshold value (Vi→Vr) in accordance with the degree to which the decreasing behavior of the detected voltage value V (T1≤T≤T2) is alleviated when the external light Le enters compared to when the external light Le does not enter, as shown in FIG. 11. As a result, as shown in FIG. 11, it is possible to align the timing (T=Ts) at which the black mark PM is detected using the initial threshold value Vi that was set presuming a time when the external light Le does not enter, and the timing at which the black mark PM is detected upon application of the corrected threshold value Vr when the external light Le actually enters. As a result, the aforementioned problems are avoided, making it possible to maintain with high accuracy the feeding control and printing control of the tag tape 53, etc., in the tag label producing apparatus 1.

Note that while in this embodiment the existence of the black mark PM is detected (time Ts) based on the decrease in and arrival of the detected voltage value V at the corrected threshold value Vr as described above, the present disclosure is not limited thereto. That is, the existence of the black mark PM may be detected based on the increase in and arrival of the detected voltage V at the corrected threshold value Vr (time Tf).

The details of the control executed by the CPU 44 of the tag label producing apparatus 1 to achieve a function such as described above will now be described with reference to FIG. 12.

Figure 12:
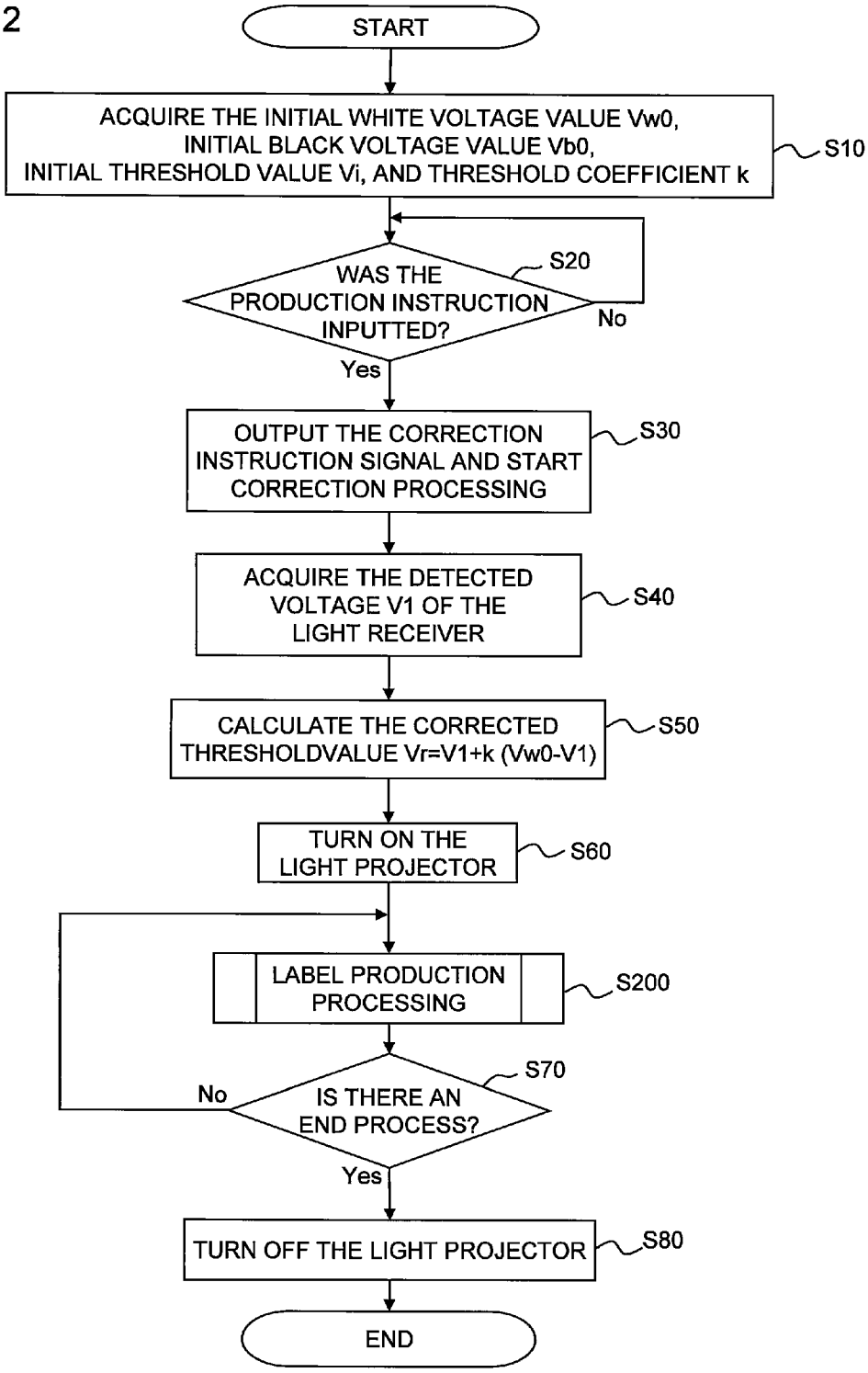
FIG. 12 is a flowchart illustrating the control contents executed by the CPU of the tag label producing apparatus.

In FIG. 12, the flow is started ("START" position) when the operator turns ON the power of the tag label producing apparatus 1, for example. Note that, at this start point, the light projecting device 35A of the above-described mark sensor 35 is in an off state.

First, in step S10, the correction instruction part 44*a* of the CPU 44 acquires the initial white voltage value Vw0, the initial black voltage value Vb0, the initial threshold value Vi, and the threshold coefficient k by reading the values from the above-described EEPROM 47. Note that the threshold coefficient k may be calculated rather than stored in the above-described EEPROM 47 by using the aforementioned Equation 1 based on the read initial white voltage value Vw0, initial black voltage value Vb0, and initial threshold value Vi.

Subsequently, in step S20, the correction instruction part 44*a* of the CPU 44 assesses whether or not a label production instruction signal (including print data) for producing one RFID label T has been inputted from the operation terminal 100 via the cable 5 and the communication interface 43. Until the above-described label production signal is inputted, the decision is made that the condition is not satisfied and the routine remains in a wait loop. Once the above-described label production signal is inputted, the decision is made that the condition is satisfied and the flow proceeds to step S30.

In step S30, the correction instruction signal is issued from the above-described correction instruction part 44*a* of the CPU 44, and the above-described correction processing part 44*b* to which this signal is inputted starts the calculation process of the corrected threshold value Vr. That is, the procedure from the above-described steps S10 to S30 is executed by the correction instruction part 44*a* of the CPU 44, while the procedure starting from step S40 is executed by the correction processing part 44*b* of the CPU 44.

Then, the flow proceeds to step S40 where the correction processing part 44*a* of the CPU 44 acquires the detected voltage value V from the light receiving device 35B. That is, at this moment, the light projecting device 35A is in an off state and the aforementioned detected voltage value V1 substantially corresponding to only the amount of the external light Le received by the light receiving device 35B is acquired.

Subsequently, the flow proceeds to step S50 where the correction processing part 44*a* of the CPU 44 calculates the corrected threshold value Vr=V1+k (Vw0−V1) using the aforementioned Equation 2, based on the initial white voltage value Vw0 and threshold coefficient k acquired in the above-described step S10, and the detected voltage value V1 detected in the above-described step S40.

Then, the flow proceeds to step S60 where the correction processing part 44*a* of the CPU 44 turns on the light projecting device 35A. Subsequently, the flow proceeds to step S200.

In step S200, the correction processing part 44*a* of the CPU 44 executes the label production process (refer to FIG. 13 described later for a detailed procedure) for producing the RFID label T using the thermal print mechanism 6.

Then, the flow proceeds to step S70 where the correction processing part 44*a* of the CPU 44 assesses whether or not a predetermined end operation (power off of the tag label producing apparatus 1, for example) has been performed. In a case where the end operation has not been performed, the decision is made that the condition is not satisfied, and the flow returns to step S200 where the same procedure is repeated. In a case where the end operation has been performed, the decision is made that the condition is satisfied, the light projecting device 35A is turned off in the next step S80, and the flow ends.

The detailed procedure of step S200 of the above-described FIG. 12 will now be described with reference to FIG. 13.

Figure 13:
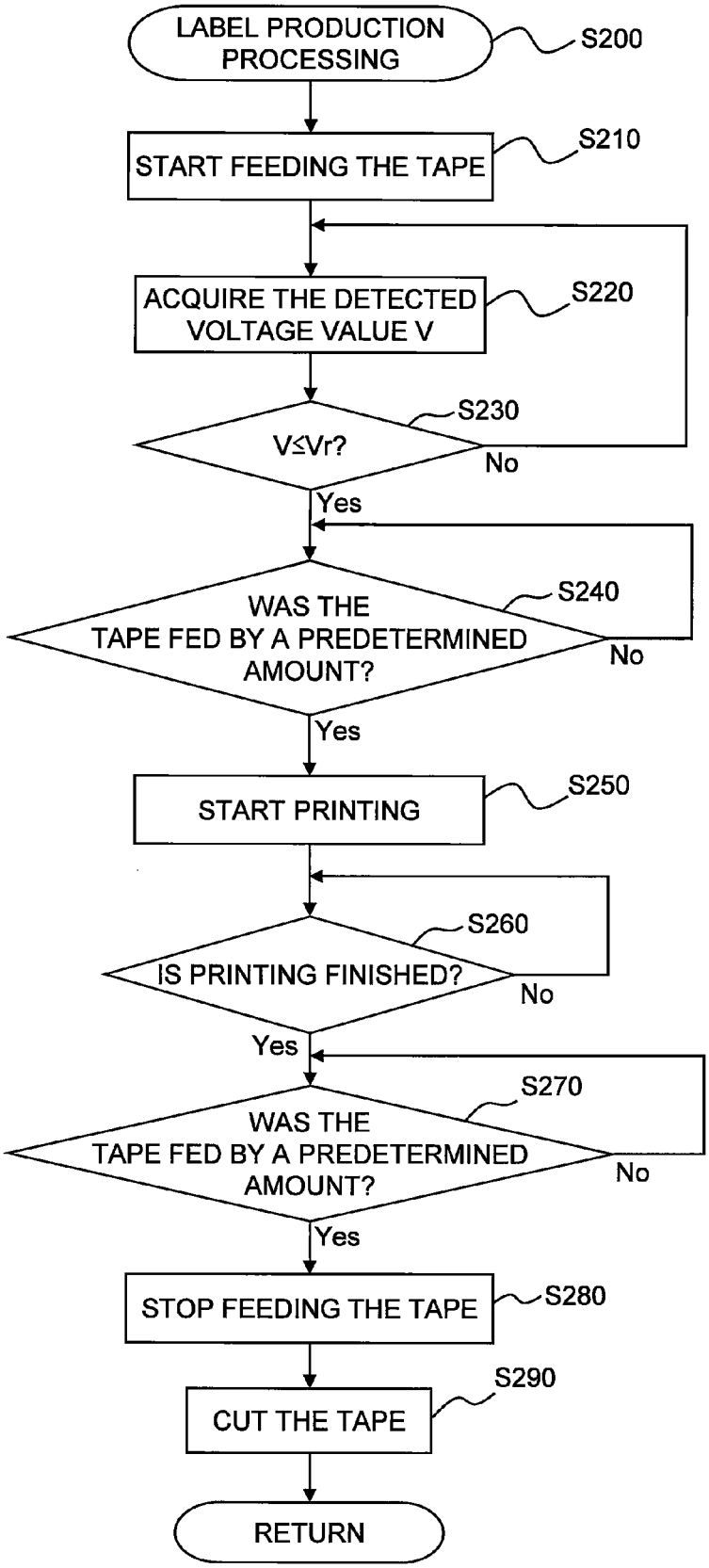
FIG. 13 is a flowchart which shows the detailed procedure of step S200.

In FIG. 13, first, in step S210, the correction processing part 44*a* of the CPU 44 outputs a control signal to the feeding motor driving circuit 33 via the input/output interface 41, and drives the feeding roller driving shaft 14 and the ribbon take-up roller driving shaft 15 by the feeding motor 32. With this arrangement, feed-out of the tag tape 53 from the tag tape roll 38 and feed-out of the cover film 51 from the cover film roll 39 are started, thereby starting the feeding of the tag tape 53, etc.

Subsequently, the flow proceeds to step S220 where the correction processing part 44*a* of the CPU 44 acquires the detected voltage value V from the light receiving device 35B.

Subsequently, the flow proceeds to step S230 where the correction processing part 44*a* of the CPU 44 assesses whether or not the detected voltage value V detected in the above-described step S220 is less than or equal to the corrected threshold value Vr calculated in the above-described step S50 (refer to the above-described FIG. 12). In other words, the decision is made as to whether the mark sensor 35 detected the above-described black mark PM. In a case where the detected voltage value V is greater than the corrected voltage value Vr, the decision is made that the condition is not satisfied and the flow returns to step S220 where the same procedure is repeated. In a case where the detected voltage value V has decreased to or below the corrected threshold value Vr, the decision is made that the condition is satisfied, the black mark PM is regarded as detected, and the flow proceeds to step S240.

In step S240, the correction processing part 44*a* of the CPU 44 assesses whether or not the tag tape 53, etc., has been fed a predetermined distance after detection of the above-described black mark PM in the above-described step S230. This predetermined distance is a feeding distance required for the top edge of the print area of the cover film 51 to arrive at a position substantially opposite the print head 9. The assessment can be made by, for example, detecting the feeding distance after detection of the black mark PM in the above-described step S230 (for example, by counting the number of output pulses of the feeding motor driving circuit 33 that drives the feeding motor 32). Until the tag tape 53, etc., is fed the predetermined distance, the decision is made that the condition is not satisfied and the routine enters a wait loop. Then, once the tag tape 53, etc., is fed the predetermined distance, the decision is made that the condition is satisfied and the flow proceeds to step S250.

In step S250, the correction processing part 44*a* of the CPU 44 outputs a control signal to the print-head driving circuit 31 via the input/output interface 41, causing the print head 9 to start printing the print corresponding to the print data inputted in step S20 of the above-described FIG. 12 in the print area of the cover film 51.

Then, the flow proceeds to step S260 where the correction processing part 44*a* of the CPU 44 assesses whether or not all printing has been completed in the print area of the cover film 51. Until all printing is completed, the decision is made that the condition is not satisfied and the routine enters a wait loop. Then, once all printing is completed, the decision is made that the condition is satisfied and the flow proceeds to step S270.

In step S270, the correction processing part 44*a* of the CPU 44 assesses whether or not the tag tape 53, etc., has been further fed a predetermined distance (a feeding distance by which the entire print area passes the cutter unit 30 by a predetermined length). This assessment may be made by detecting the subsequent feeding distance based on the timing of detection of the black mark PM in the above-described step S230, similar to the above-described step S240. Until the tag tape 53, etc., is fed the predetermined distance, the decision is made that the condition is not satisfied and the routine enters a wait loop. Then, once the tag tape 53, etc., is fed the predetermined distance, the decision is made that the condition is satisfied and the flow proceeds to step S280.

In step S280, the correction processing part 44*a* of the CPU 44 outputs a control signal to the feeding motor driving circuit 33 via the input/output interface 41, and stops the driving of the feeding roller driving shaft 14 and the ribbon take-up roller driving shaft 15 by the feeding motor 32. With this arrangement, the feed-out of the tag tape 53 and the cover film 51 from the tag tape roll 38 and the cover film roll 39, and the feeding of the tag tape 53, etc., are stopped.

Subsequently, in step S290, the correction processing part 44*a* of the CPU 44 outputs a control signal to the solenoid driving circuit 36 via the input/output interface 41, drives the solenoid 34, and activates the movable blade 30A of the cutter unit 30, thereby cutting the RFID label Tape 28 with print. With the cutting of this cutter unit 30, the RFID label Tape 28 with print is cut to form the RFID label T. Then, the routine ends.

As described above, in the tag label producing apparatus 1 of this embodiment, the corrected threshold value Vr=V1+k (Vw0−V1) is used in place of the initial threshold value Vi=Vb0+k (Vw0−Vb0), taking into consideration the effect caused by the external light Le. With this arrangement, the voltage value V outputted when light is projected on the black mark PM reaches the corrected threshold value Vr, making it possible to reliably detect the black mark PM based thereon. Therefore, regardless of the behavior of the detected voltage value V caused by entry of the external light Le, the black mark PM can be detected with high accuracy. As a result, it is possible to produce a high quality RFID label T without variance in the feeding distance or shift in the printing position.

Further, in particular, according to this embodiment, the initial threshold value Vi before correction is set to Vb0+k (Vw0−Vb0) which corresponds to the fluctuation width Vb0 to Vw0 of the received amount of light, while the corrected threshold value Vr is set to V1+k (Vw0−V1) which corresponds to the fluctuation width V1 to Vw0 of the received amount of light and uses the threshold coefficient k in the same proportion. With this arrangement, even in a case where the fluctuation width of the voltage value changes from Vb0−Vw0 to V1−Vw0 when the external light Le enters as described above, it is possible to keep the association between the fluctuating behavior of the detected voltage value V with the feeding position of the tag tape 53, etc., the same. That is, as previously described with reference to FIG. 11, the timing at which the black mark PM is detected using the initial threshold value Vi, and the timing at which the black mark PM is detected after applying the corrected threshold value Vr when the external light Le actually enters are the same. With this arrangement, variance in the feeding distance and shift in the printing position are reliably prevented, making it possible to produce a high-quality RFID label T.

Further, in particular, according to this embodiment, the corrected threshold value Vr is calculated in the procedure of the above-described step S50 after input of the label production instruction signal, before tape feeding is started, and before the light projecting device 35A is on. With this arrangement, when the user provides instructions for label production, it is possible to correct the threshold value in advance and then start feeding and printing. As a result, a high-quality RFID label T can be reliably produced.

Note that various modifications may be made according to the present embodiment without departing from the spirit and scope of the disclosure, in addition to the above embodiment. Description will be made below regarding such modifications.

(1) When the Output Voltage Polarity of the Light Receiving Device is Reversed

Figure 14:
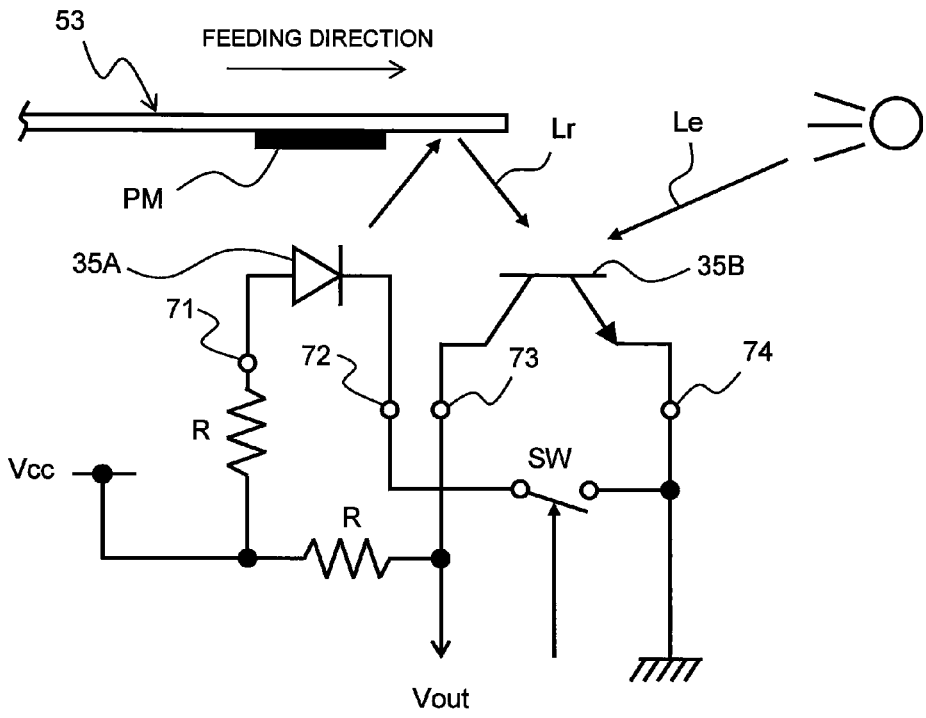
FIG. 14 is a diagram illustrating a circuit configuration of an exemplary modification of a mark sensor.

In the above-described embodiment, a phototransistor comprising the light receiving device 35B of the mark sensor 35 is collector grounded (refer to the above-described FIG. 5), causing output of a detected voltage value V that increases in proportion to the amount of light received by the light receiving device 35B. However, the present disclosure is not limited thereto, allowing the phototransistor of the light receiving device 35B to be emitter grounded as shown in FIG. 14 corresponding to the above-described FIG. 5, causing output of a detected voltage value V that decreases in reverse proportion to the amount of light received by the light receiving device 35B.

Figure 15:
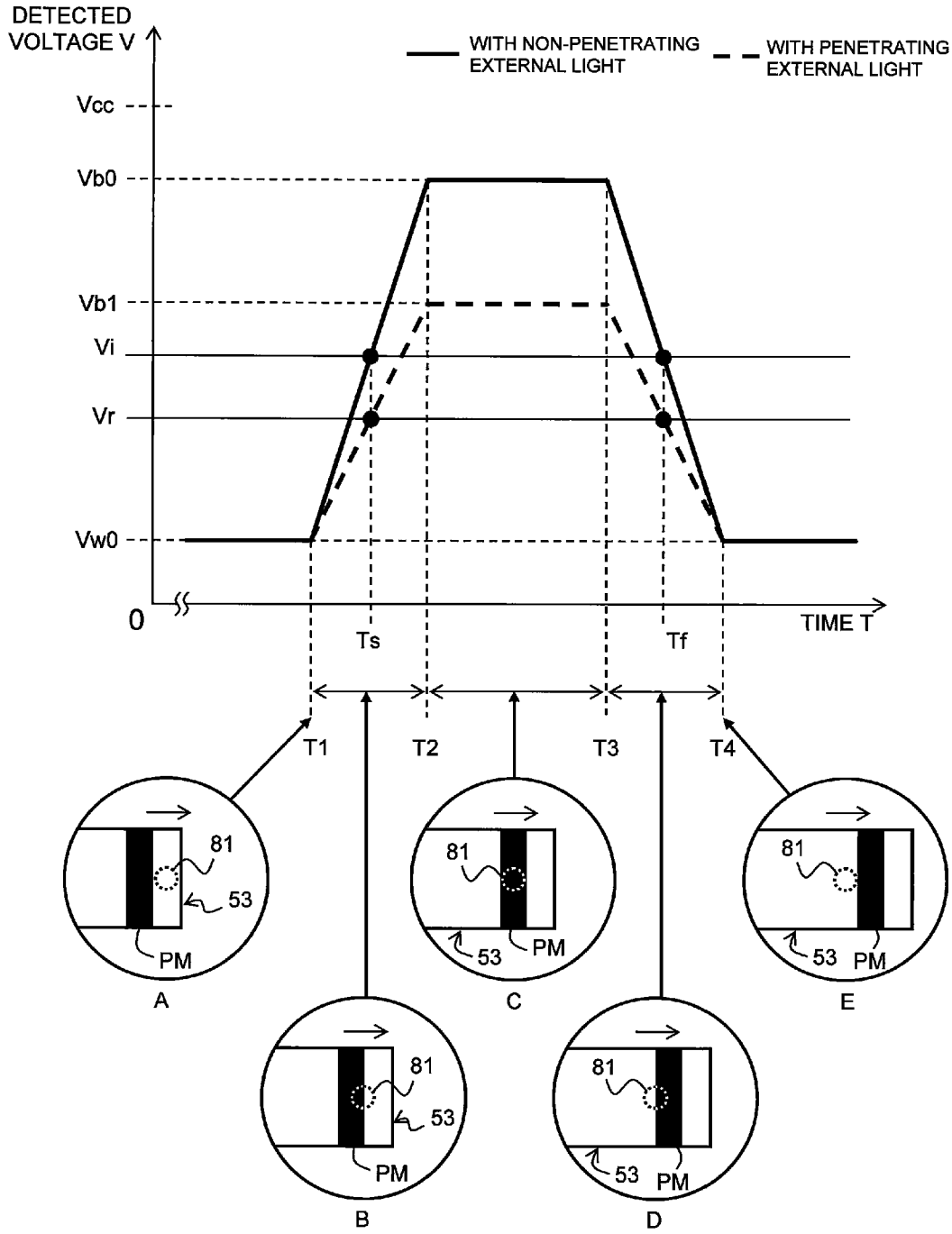
FIG. 15 is a time chart showing the change in the detected voltage value before and after detection of the black mark when the exemplary modification of the mark sensor is used.

In such a case, output of the detected voltage value V changes as shown in FIG. 15, which corresponds to the above-described FIG. 11. That is, in a case where there is no effect from the external light Le, the start (T<T1) of the feeding of the tag tape 53, etc., occurs when the output voltage value V from the light-receiving device 35B becomes the initial white voltage value Vw0 of a low level. Subsequently, when the feeding of the tag tape 53, etc., advances and T becomes larger than T1, the detected voltage value V increases, sloping upward and to the right from the above-described initial white voltage value Vw0. Subsequently, when the light projection range 81 of the light projecting device 35A completely overlaps the black mark PM at T=T2, the detected voltage value V stops increasing and becomes the initial black voltage value Vb0. Subsequently, when the light projection range 81 of the light projecting device 35A starts to move outside the black mark PM at T=T3 and T becomes larger than T3, the detected voltage value V decreases, sloping downward and to the right from the above-described initial black voltage value Vb0. Subsequently, the light projection range 81 of the light projecting device 35A moves fully away from the black mark PM at T=T4, and the detected voltage value V returns to the aforementioned initial white voltage value Vw0.

In such a case, the initial threshold value Vi set in advance at the time of factory shipment, for example, is set by the following:

$$Vi=Vb0-k(Vb0-Vw0) \quad \text{(Equation 3)}$$

As is clear from Equation 3, similar to the previously described Equation 1, given an interval 1 from Vb0 to Vw0, which is the fluctuation width of the detected voltage value V, this initial threshold value Vi also applies k times the interval length from Vw0 toward Vb0 to divide the above-described interval. With this arrangement, similar to the above-described embodiment, the detected voltage value V increases in the above-described range T1≤T≤T2 when the external light Le does not enter, making it possible to detect that the black mark PM has arrived at a position opposite the mark sensor 35 when V=Vi (T=Ts).

On the other hand, in a case where there is an effect from the external light Le, similar to the aforementioned embodiment, the fluctuation width (from the above-described true black voltage value Vb1 to the initial white voltage value Vw0) of the detected voltage value V caused by the existence of the black mark PM becomes smaller than the fluctuation width (from the above-described initial black voltage value Vb0 to the initial white voltage value Vw0) of the above-described detected voltage value V caused by the existence of the black mark PM when the external light Le does not enter. That is, the fluctuation width of the detected voltage value V reduces from "Vb0−Vw0" to "Vb1−Vw0."

In this modification as well, the threshold value is corrected in the same manner as in the above-described embodiment in accordance with the fluctuation width. That is, in this modification, the corrected threshold value Vr is calculated using the following equation:

$$Vr=V1-k(V1-Vw0) \quad \text{(Equation 4)}$$

As is clear from Equation 4, the corrected threshold value Vr is equivalent to a voltage value that, given an interval 1 from V1 to Vw0, which is the fluctuation width of the detected voltage value V when the aforementioned external light Le enters, applies k times the interval length to divide the above-described interval as previously described. As a result, similar to the above-described embodiment, as shown in FIG. 15, the timing at which the black mark PM is detected using the initial threshold value Vi set presuming a time when the external light Le does not enter, and the timing at which the black mark PM is detected upon actual application of the corrected threshold value Vr when the external light Le actually does enter are the same (T=Ts). Therefore, in this modification as well, it is possible to maintain with high accuracy the feeding control and printing control of the tag tape 53, etc., in the tag label producing apparatus 1.

Note that, as understood upon comparison of the above-described Equation 1 and Equation 3, these two are the same equation. Further, Equation 2 and Equation 4 are the same equation as well. Therefore, Equation 1 and Equation 3 may be used in common for cases where a detected voltage value V that increases in proportion to the amount of received light is outputted as in the above described embodiment, and for cases where a detected voltage value V that increases in reverse proportion to the amount of received light is outputted as in the above-described embodiment.

(2) When Correction is Made after Detection of the Passing of the Front End of the Tag Tape, Etc., by the Mark Sensor While the corrected threshold value Vr is calculated immediately after the start of tag label production in the above-described embodiment, the present disclosure is not limited thereto, allowing calculation of the corrected threshold value Vr after detection of the passing of the front end of the tag tape by the instruction mark sensor 35.

Figure 16:
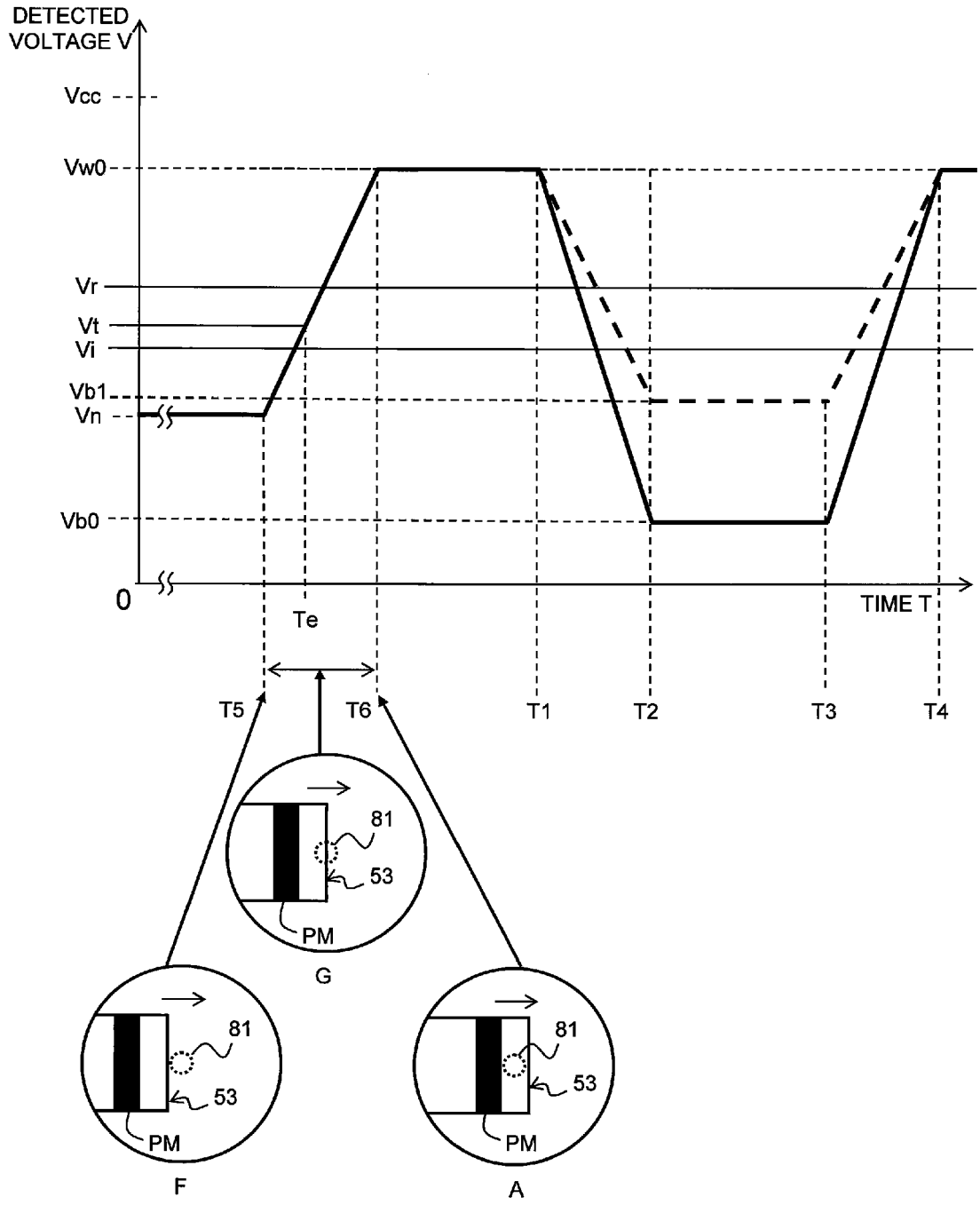
FIG. 16 is a time chart showing the change in the detected voltage value V before and after the mark sensor detects the front end of the tag tape, etc., in an exemplary modification in which correction is performed after detection of the passing of the front end of the tag tape.

That is, as shown in FIG. 16 corresponding to FIG. 11 of the above-described embodiment, light projection by the light projecting device 35A is started immediately after the start of feeding of the tag tape 53, etc., based on the label production instruction signal. In such a case, the light projection range 81 is positioned in a section away from the front end of the tag tape 53, etc. (refer to FIG. 10A), eliminating any reflection from the front end of the tag tape 53, etc. (refer to section F in FIG. 16). As a result, the detected voltage value V from the light receiving device 35B becomes a relatively high no-reflection voltage value Vn when there is an effect from the external light Le.

Subsequently, when the feeding of the tag tape 53, etc., advances, the light projection range 81 of the light projecting device 35A starts to overlap with the tape front end based on a certain timing (T=T5). Then, as the feeding of the tag tape 53, etc., advances, the range in which the tape front end and the light projection range 81 overlap increases (refer to Section G in FIG. 16). With this arrangement, the received amount of reflected light Lr caused by the tape increases, causing the received amount of reflected light Lr of the light receiving device 35B to increase along with the increase in the range in which the tape front end and the light projection range 81 overlap. As a result, when T becomes greater than T5, the detected voltage value V increases, sloping upward and to the right from the above-described no-reflection voltage value Vn.

In this modification, as described above, the arrival of the tape front end at the position opposite the mark sensor 35 is detected using the fluctuation (no-reflection voltage value Vn→initial white voltage value Vw0) of the detected voltage value V caused by the existence of the tape front end, resulting in detection of the front end position of the tag tape 53, etc. Specifically, a threshold value Vt (hereinafter simply referred to as the tape threshold value) associated with the detected voltage value V is set in advance at the time of factory shipment, for example. This tape threshold value Vt is appropriately set between the above-described no-reflection voltage value Vn and the initial white voltage value Vw0 in accordance with the above-described behavior. With this arrangement, the detected voltage value V increases in the above-described range T5≤T≤T6 and, based on the timing at which V=Vt (the timing of T=Te shown in FIG. 16), the arrival of the tape front end of the tag tape 53, etc., at the position opposite the mark sensor 35 can be detected. Note that the value of the above-described tape threshold value Vt is stored in advance in the EEPROM 47 of the above-described control circuit 40.

Subsequently, when the feeding of the tag tape 53, etc., advances further, the light projection range 81 of the light projecting device 35A completely overlaps with the tag tape front end section based on a certain timing (T=T6; refer to Section A in FIG. 16). In this state, the detected voltage value V that had increased as described above stops increasing and becomes the aforementioned initial white voltage value Vw0. This state is subsequently maintained until time passes and T=T1.

Subsequently, when the feeding of the tag tape 53, etc., advances further, the light projection range 81 of the light projecting device 35A starts to overlap with the black mark PM at the aforementioned T=T1. From this point on, the process is the same as the above-described embodiment, and description thereof will be omitted.

Note that detection of the aforementioned detected voltage value V1 required for calculation of the corrected threshold value Vr used to detect the black mark PM may be achieved by temporarily turning off the light projecting device 35A and measuring the detected voltage value V1 corresponding to the received amount of the external light Le after detection of the front end of the tag tape 53, etc., at T5≤T≤T6 as described above, and then turning the light projecting device 35A back on again.

The control contents executed by the CPU 44 of the tag label producing apparatus 1 in this exemplary modification will now be described with reference to FIG. 17. Note that this FIG. 17 corresponds to the aforementioned FIG. 12, and the same steps as those in FIG. 12 are denoted using the same reference numbers, with descriptions thereof suitably omitted.

Figure 17:
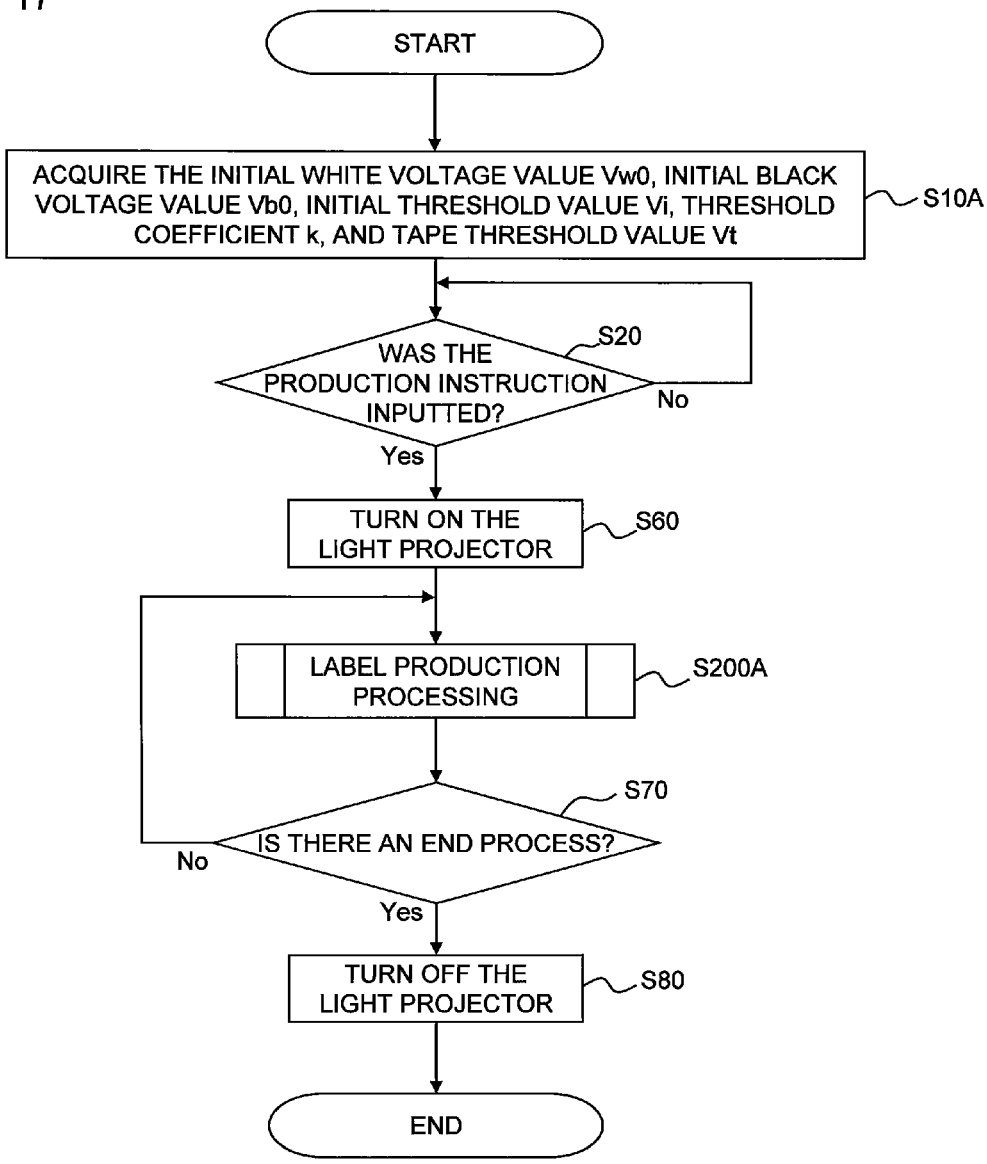
FIG. 17 is a flowchart illustrating the control contents executed by the CPU of the tag label producing apparatus.

The flow in FIG. 17 differs from the flow in the aforementioned FIG. 12 in that a step S10A is provided in place of the step S10, the steps S30, S40, and S50 are eliminated, and a step S200A is provided in place of the step S200.

In step S10A, the correction instruction part 44*a* of the CPU 44 acquires the above-described tape threshold value Vt in addition to the initial white voltage value Vw0, the initial black voltage value Vb0, the initial threshold value Vi, and the threshold coefficient k. The step S20 following the step S10A, and the step S60 thereafter are the same as those in the aforementioned FIG. 12. Further, the steps S70 and S80 are also the same as those in FIG. 12, and descriptions thereof will be omitted.

The detailed procedure of step S200A of the above-described FIG. 17 will now be described with reference to FIG. 18. Note that this FIG. 18 corresponds to the aforementioned FIG. 13, and the same steps as those in FIG. 13 are denoted using the same reference numbers, with descriptions thereof suitably omitted.

Figure 18:
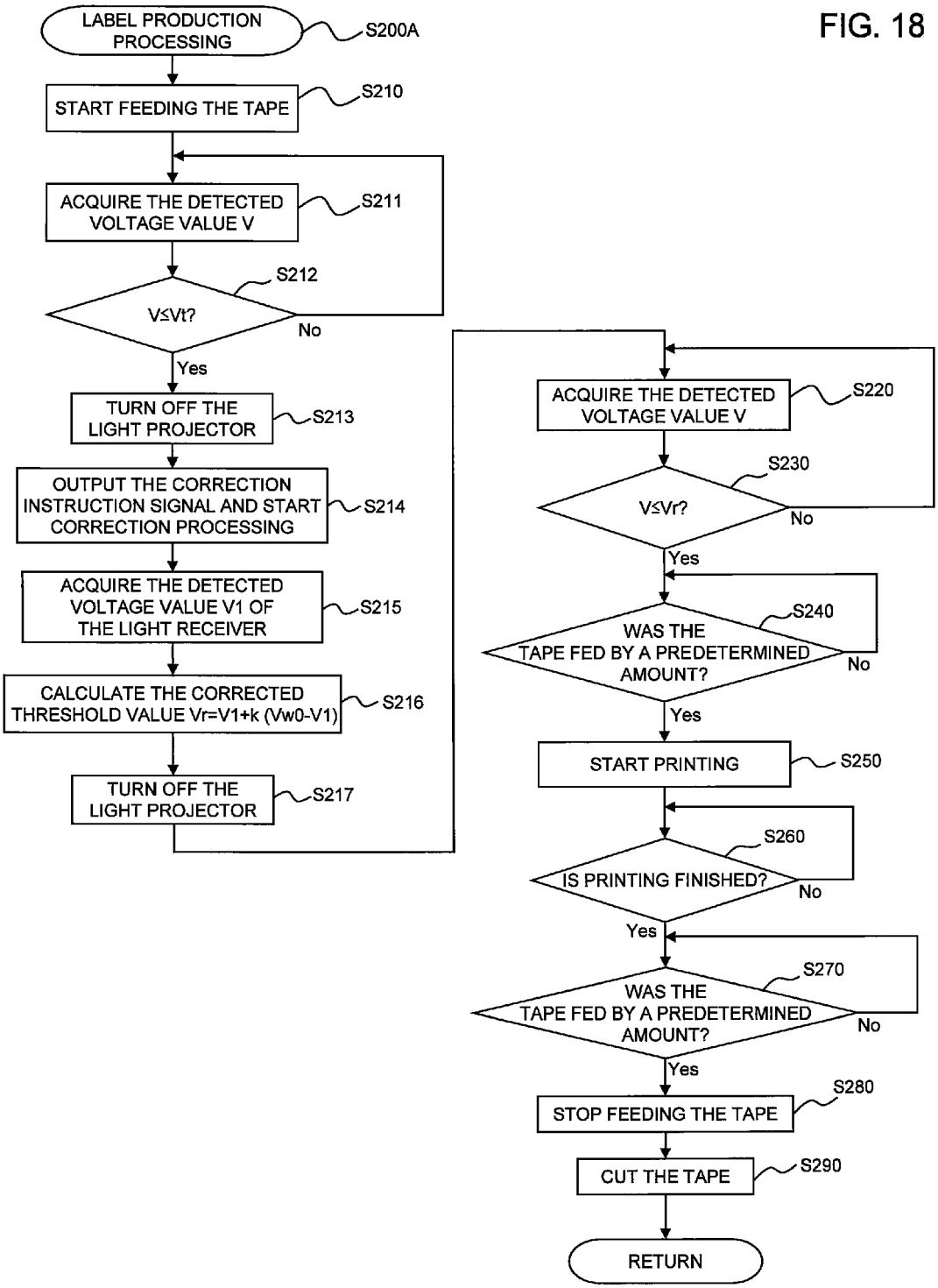
FIG. 18 is a flowchart which shows the detailed procedure of step S200A.

In FIG. 18, the flow differs from the flow in the aforementioned FIG. 13 in that step S211 to step S217 are newly provided between step S210 and step S220.

In FIG. 18, first, in step S210, the correction instruction part 44*a* of the CPU 44 starts the feeding of the tag tape 53, etc., as previously described.

Then, the flow proceeds to step S211 where the correction processing part 44*a* of the CPU 44 acquires the detected voltage value V from the light receiving device 35B.

Subsequently, the flow proceeds to step S230 where the correction instruction part 44*a* of the CPU 44 assesses whether or not the detected voltage value V detected in the above-described step S211 has increased to the tape threshold value Vt acquired in the above-described step S10A or higher. In other words, the decision is made as to whether the mark sensor 35 detected the front end section of the tag tape 53, etc. In a case where the detected voltage value V is lower than the tape threshold value Vt, the decision is made that the condition is not satisfied and the flow returns to step S211 where the same procedure is repeated. In a case where the detected voltage value V increases to the tape threshold value Vt or higher, the decision is made that the condition is satisfied and the flow proceeds to step S213.

In step S213, the correction instruction part 44*a* of the CPU 44 turns off the light projecting device 35A and proceeds to step S214.

In step S214, the correction instruction signal is issued from the above-described correction instruction part 44*a* of the CPU 44, and the above-described correction processing part 44*b* to which this signal is inputted starts the calculation process of the corrected threshold value Vr. In other words, the procedure from the above-described step S10 to step S213 is executed by the correction instruction part 44*a* of the CPU 44, while the procedure starting from step S215 is executed by the correction processing part 44*b* of the CPU 44.

Subsequently, the flow proceeds to step S215 where the correction processing part 44*a* of the CPU 44 acquires the detected voltage value V1 from the light receiving device 35B in the same manner as the above-described step S30.

Then, the flow proceeds to step S216 where the correction processing part 44*a* of the CPU 44 calculates the corrected threshold value Vr=V1+k (Vw0−V1) in the same manner as in the above-described step S50.

Subsequently, the flow proceeds to step S217 where the correction processing part 44*a* of the CPU 44 turns on the light projecting device 35A. Subsequently, the flow proceeds to step S220.

The procedure starting from the step S220 is the same as that in the above-described FIG. 12, and a description thereof will be omitted. Note that the assessment of the tape feeding distance in each of the steps S240 and S270 may be made by assessing the tape feeding distance and the timing at which the front end section of the tag tape 53, etc., is detected, rather than only the detection timing of the black mark PM by the mark sensor 35.

In the tag label producing apparatus 1 of this modification, when the user provides label production instructions, the front end of the tag tape 53, etc., is first detected in the above-described steps S211 and S212. With this arrangement, even if the feeding position of the tag tape 53, etc., has shifted (with respect to the feeding position presumed in advance) for some reason after the previous time the user produced the RFID label T, the position at the time of the above-described front end detection is used as the positioning standard, making it possible to execute highly accurate feeding control and printing control without any effect from the above-described shift. Then, in this modification, after the above-described front end detection, the feeding and printing for RFID label T production is started after the threshold value is further corrected, making it possible to reliably produce a high quality RFID label T.

(3) Other

While in the above the RFID label T is produced using the tag tape 53 in which the RFID circuit element To is disposed at the above-described fixed pitch Pt, the present disclosure is not limited thereto. That is, the present disclosure may be applied to a case where a printed label is produced using a base tape that is not provided with the RFID circuit element To.

Further, while the above has described an illustrative scenario in which the RFID label Tape 110 with print is cut by the cutter 15 to produce the RFID label Tape T, the present disclosure is not limited thereto. That is, in a case where a label mount (a so-called die cut label) separated in advance to a predetermined size corresponding to the label is continuously disposed on the tape fed out from the roll, the present disclosure may also be applied to a case where the label is not cut by the cutter unit 30 but rather the label mount (a label mount containing the RFID circuit element To on which corresponding printing has been performed) only is peeled from the tape after the tape has been discharged from the discharging exit 4 so as to form the RFID label T.

While the above employs a method in which printing is performed on the cover film 51 separate from the tag tape 53 (or the above-described base tape) and then the two are bonded together, the present disclosure is not limited thereto. That is, a method (non-bonding type) in which printing is performed on a print-receiving tape layer provided on the tag tape or the base tape itself (a thermosensitive layer comprising a thermosensitive material capable of developing color and forming print by heat, a transfer layer comprising transfer receiving material capable of forming print by thermal transfer from an ink ribbon, or an image receiving layer comprising an image receiving material capable of print formation when ink is applied) may be applied to the present disclosure. In such a case, the tag tape and base tape correspond to the label tape described in the claims.

Further, in the above, suitable wireless communication device may be provided so that RFID tag information reading and writing is performed from the IC circuit part 150 of the RFID circuit element To. In such a case, the printing does not necessarily need to be performed using the print head 10, and the present disclosure may be applied to a case where RFID tag information is only read or written.

Furthermore, while the above has been described in connection with an illustrative scenario in which the tag tape 53 is wound around a reel member so as to form a roll, and the roll is disposed within the cartridge 21 so as to feed out the tag tape 53, the present disclosure is not limited thereto. For example, an arrangement can be made as follows. Namely, a long-length or rectangular tape or sheet (including tape cut to a suitable length after being supplied from a roll) in which at least one RFID circuit element To is disposed is stacked (laid flat and layered into a tray shape, for example) in a predetermined housing part so as to form a cartridge. The cartridge is then mounted to the cartridge holder provided to the tag label producing apparatus 1. Then, the tape or sheet is supplied or fed from the housing part, and printing or writing is performed so as to produce the RFID labels T.

Furthermore, a configuration wherein the above-described roll is directly removably loaded to the tag label producing apparatus 1 side, or a configuration wherein a long, flat paper-shaped or strip-shaped tape or sheet is moved one piece at a time from outside the tag label producing apparatus 1 by a predetermined feeder mechanism and supplied to within the tag label producing apparatus 1 is also possible. Additionally, the structure of the roll is not limited to a type that is removable from the tag label producing apparatus 1 main body, such as the cartridge 21, but rather the tag tape roll may be provided as a so-called installation type or an integrated type that is not removable from the apparatus main body 2 side. In each of these cases as well, the same advantages are achieved.

Note that the arrows shown in each figure above, such as FIG. 4, FIG. 5 and FIG. 9, denote an example of signal flow, but the signal flow direction is not limited thereto.

Also note that the present disclosure is not limited to the procedure illustrated in the flowcharts of FIG. 12, FIG. 13, FIG. 17, FIG. 18, etc., and additions and deletions as well as sequence changes to the procedure may be made without departing from the spirit and scope of the disclosure.

Additionally, other than those previously described, methods according to the above-described embodiment and modification examples may be utilized in combination as appropriate.

What is claimed is:

1. A label producing apparatus comprising:

a housing including a discharging exit;

a feeding device provided inside said housing that feeds a label tape comprising a light absorbing positioning mark toward said discharging exit;

a printing device that prints desired print on the label tape to be fed by said feeding device or a print receiving tape to be bonded to said label tape;

an optical sensor provided inside said housing, and comprising a light projecting device capable of projecting light toward a feeding path of said label tape to be fed by said feeding device and a light receiving device capable of outputting a detected voltage value corresponding to a received amount of light;

a light-on control portion that controls said optical sensor so that said light projecting device is turned on in accordance with an input of a label production instruction signal;

an initial value storage device that stores a predetermined initial threshold value in relation to said detected voltage detected by said light receiving device;

a threshold value correction portion that calculates a corrected threshold value using said initial threshold value stored in said initial value storage device in accordance with a correction instruction signal issued at a predetermined time at which said light projecting device is off and an external light can enter the inside of said housing from said discharging exit;

a mark detecting portion that detects said positioning mark by an arrival of said detected voltage value of said light receiving device at said corrected threshold value after calculation of said corrected threshold value by said threshold value correction portion and with said light projecting device in an on state;

a feeding control portion that controls said feeding device so that feeding is started in accordance with an input of the label production instruction signal, and to control a feeding operation of said feeding device based on a detection result of said mark detecting portion; and a print control portion that controls a print operation of said printing device based on the detection result of said mark detecting portion wherein said initial value storage device stores a predetermined initial white voltage value Vw0 and initial black voltage value Vb0 corresponding to a range of said detected voltage values of said light receiving device, and said predetermined initial threshold value as equal to Vb0+k (Vw0−Vb0) related to the range of said detected voltage values where k is a number less than 1;

said threshold value correction portion calculates said corrected threshold value as equal to V1+k (Vw0−V1), where V1 is said detected voltage value of said light receiving device when said correction instruction signal is issued, based on said predetermined initial white voltage value Vw0 stored in said initial value storage device and in accordance with said correction instruction signal; and said mark detecting portion detects said positioning mark by the arrival of said detected voltage value of said light receiving device at said corrected threshold value V1+k (Vw0−V1) after calculation of said corrected threshold value V1+k (Vw0−V1) by said threshold value correction portion and with said light projecting device in an on state.

2. The label producing apparatus according to claim 1, further comprising:

a first correction instruction portion that outputs said correction instruction signal at said predetermined time, which is after input of said label production instruction signal, before said feeding device starts feeding based on the control of said feeding control portion, and before said light projecting device turns on based on the control of said light-on control portion; wherein:

said threshold value correction portion calculates said corrected threshold value as equal to V1+k (Vw0−V1) based on said detected voltage value V1, in accordance with said correction instruction signal inputted from said first correction instruction portion.

3. The label producing apparatus according to claim 1, further comprising:

a tape detecting portion that detects a passing of a front end of said label tape by an arrival of the detected voltage value V of said light receiving device at a predetermined tape threshold value Vt after said feeding device starts feeding based on the control of said feeding control portion after input of said label production instruction signal and with said light projecting device in an on state based on the control of said light-on control portion;

a light-off control portion that turns off said light projecting device when said tape detecting portion detects the passing of the front end of said label tape; and a second correction instruction portion that outputs said correction instruction signal at said predetermined time, which is after said light projecting device turns off based on the control of said light-off control portion; wherein:

said threshold value correction portion calculates said corrected threshold value as equal to V1+k (Vw0−V1) based on said detected voltage value VI, in accordance with said correction instruction signal inputted from said second correction instruction portion.

* * * * *